US011272787B2

(12) United States Patent
Nill

(10) Patent No.: US 11,272,787 B2
(45) Date of Patent: Mar. 15, 2022

(54) PIVOT FITTING AND PIECE OF FURNITURE

(71) Applicant: HETTICH FRANKE GMBH & CO. KG, Balingen-Weilstetten (DE)

(72) Inventor: Oliver Nill, Hechingen (DE)

(73) Assignee: HETTICH FRANKE GMBH & CO. KG, Balingen-Weilstetten (DE)

( * ) Notice: Subject to any disclaimer, the term of this patent is extended or adjusted under 35 U.S.C. 154(b) by 213 days.

(21) Appl. No.: 16/612,186

(22) PCT Filed: May 7, 2018

(86) PCT No.: PCT/EP2018/061682
§ 371 (c)(1),
(2) Date: Nov. 8, 2019

(87) PCT Pub. No.: WO2018/206486
PCT Pub. Date: Nov. 15, 2018

(65) Prior Publication Data

US 2021/0007488 A1 Jan. 14, 2021

(30) Foreign Application Priority Data

May 11, 2017 (DE) ..... 10 2017 110 253.1

(51) Int. Cl.
*A47C 1/03* (2006.01)
*A47C 1/026* (2006.01)
(Continued)

(52) U.S. Cl.
CPC ..... *A47C 1/0308* (2018.08); *A47C 1/026* (2013.01); *A47C 1/036* (2013.01); *A47C 7/38* (2013.01); *A47C 7/541* (2018.08)

(58) Field of Classification Search
CPC ..... A47C 1/0308; A47C 1/026; Y10T 403/32319; Y10T 403/32327;
(Continued)

(56) References Cited

U.S. PATENT DOCUMENTS 3,779,655 A 12/1973 Toyota
4,087,885 A * 5/1978 Gillentine ..... B60N 2/236 16/325
(Continued)

FOREIGN PATENT DOCUMENTS

DE 8200129 U1 * 5/1982 ..... A47C 1/026
DE 202006019497 U1 6/2007
(Continued)

OTHER PUBLICATIONS

International Search Report dated Jul. 4, 2018 in related/corresponding International Application No. PCT/EP2018/061682.
(Continued)

*Primary Examiner* — Robert Canfield
(74) *Attorney, Agent, or Firm* — Patent Portfolio Builders PLLC

(57) ABSTRACT

A pivot fitting for moveable furniture parts on upholstered furniture has a first lever and a second lever that are mounted to as to pivot relative to each other about a common axis from a basic position through a predetermined angle. The pivot fitting also includes a clamping mechanism with which the two levers can be fixed relative to each other at different angular positions within the predetermined angle, the clamping mechanism has a toothing attached in a rotationally fixed manner on the second lever, at least one catch that is pivotally mounted on the first lever and loaded in the direction of the toothing, the catch engaging with the toothing in a detent position. A first control disc is mounted so as to pivot about the common axis, with which the at least one
(Continued)

Figure 1:
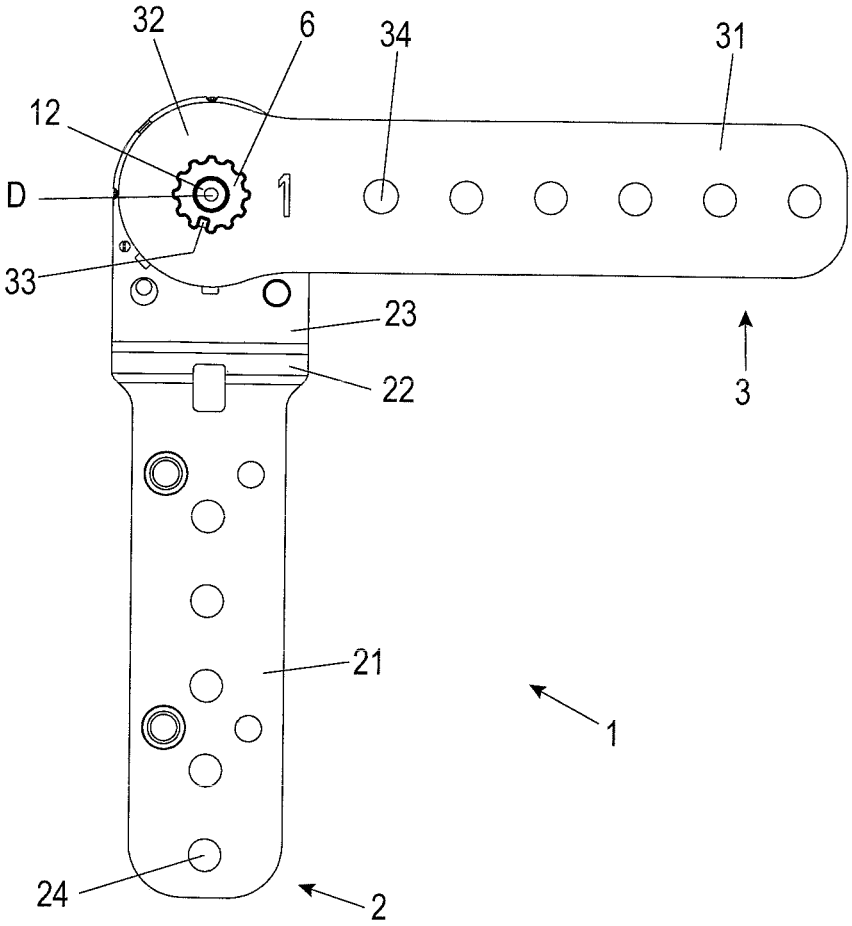

catch is disengageable from the toothing when the predetermined angle has been passed from the basic position into an adjusting direction, such that when the catch is disengaged from the toothing, the two levers can be pivoted back into the basic position when the predetermined angle is passed in a resetting direction. The first control disc can be carried by the toothing, resting thereon with a friction fit, and is mounted so as to pivot about a switching angle relative to the first lever and wherein a second control disc mounted so as to pivot about the common axis can be carried by the toothing and is mounted so as to pivot about a switching angle relative to the toothing.

18 Claims, 25 Drawing Sheets

(51) Int. Cl.
*A47C 1/036* (2006.01)
*A47C 7/38* (2006.01)
*A47C 7/54* (2006.01)

(58) Field of Classification Search
CPC ..... Y10T 403/32336; Y10T 403/32352; Y10T 403/32368
See application file for complete search history.

(56) References Cited

U.S. PATENT DOCUMENTS

| | | | | |
|---|---|---|---|---|
| 6,609,758 | B1 * | 8/2003 | Lefevere | B60N 2/763 297/411.38 |
| 9,167,898 | B2 | 10/2015 | Wahls et al. | |
| 9,399,421 | B2 * | 7/2016 | Lu | A47C 7/38 |
| 9,790,985 | B2 * | 10/2017 | Haug | A47C 7/54 |
| 2005/0205735 | A1 * | 9/2005 | Ichikawa | G07G 1/0018 248/292.12 |
| 2009/0309403 | A1 * | 12/2009 | Mackert | A47C 1/026 297/354.13 |
| 2013/0011181 | A1 | 1/2013 | Riedmueller | |
| 2017/0367483 | A1 * | 12/2017 | Fecker | A47C 7/52 |

FOREIGN PATENT DOCUMENTS

| | | | | |
|---|---|---|---|---|
| DE | 102010055529 | A1 | 6/2012 | |
| DE | 102013220126 | A1 | 4/2014 | |
| DE | 102013108665 | A1 | 2/2015 | |
| DE | 102015100527 | A1 | 7/2016 | |
| DE | 102017110246 | A1 * | 11/2018 | A47C 7/38 |
| DE | 102017110249 | A1 * | 11/2018 | A47C 7/541 |
| DE | 102017129057 | A1 * | 6/2019 | A47C 1/026 |
| DE | 102019113248 | A1 * | 11/2020 | A47C 1/023 |
| EP | 1284447 | A1 | 2/2003 | |
| EP | 1510150 | A2 * | 3/2005 | A47C 1/026 |
| EP | 2544567 | A1 | 1/2013 | |
| EP | 3058850 | A1 * | 8/2016 | A47C 7/402 |
| EP | 3400835 | A1 * | 11/2018 | A47C 20/043 |
| JP | 4296223 | B1 * | 7/2009 | A47C 1/026 |
| WO | WO-2006040303 | A2 * | 4/2006 | B60N 2/2252 |
| WO | WO-2007088128 | A1 * | 8/2007 | A47C 1/026 |
| WO | WO-2019198250 | A1 * | 10/2019 | A47C 1/026 |

OTHER PUBLICATIONS

Search Report dated Apr. 20, 2018 on in related/corresponding DE Application No. 10 2017 110 253.1.
Written Opinion dated Jul. 4, 2018 in related/corresponding International Application No. PCT/EP2018/061682.
Search Report dated Jun. 14, 2021 in related/corresponding EP Application No. 21161084.5.

* cited by examiner

PIVOT FITTING AND PIECE OF FURNITURE

BACKGROUND AND SUMMARY OF THE INVENTION

Exemplary embodiments of the present invention relate to a pivot fitting and a piece of furniture having such a pivot fitting.

A pivot fitting of the type in question is known, for example, from EP 2 544 567 B1 in which two levers are fixable in relation to one another via a catch mechanism. One of these levers can be fastened in this case on a base body or seat part of a piece of furniture, for example, a piece of upholstered furniture, while the second lever is used, for example, for fixing a pivotably mounted head support, which is fixed with the aid of the pivot fitting from a starting position in predetermined catch steps.

To change this fixing position further in the adjustment direction, the catch fitting can be pivoted further in a simple manner. In contrast, to reach a new catch position, which was already passed through during the preceding setting procedure, it is necessary to pivot the catch fitting completely into its end position and from there to pivot the catch fitting back into its base position, to subsequently pivot the catch fitting back in the initial pivot direction into the desired catch step.

To switch over the pivot fitting, it has to be pivotable by a predetermined adjustment angle of approximately 20° beyond the latching in the adjustment direction.

Exemplary embodiments of the present invention are directed to a pivot fitting in which the adjustment procedure from a first into a second catch position can be carried out in an even simpler manner and using which a greater catch range is enabled with equal adjustment distance.

The pivot fitting according to the invention, in particular for movable furniture parts on pieces of seating or reclining furniture, comprises a first lever and a second lever, which are mounted so they are pivotable in relation to one another around a common axis from a base position by a predetermined angle.

The two levers are fixable in relation to one another in different angular positions within the predetermined angle using a clamping or catch mechanism of the pivot fitting.

The clamping or catch mechanism comprises in this case a toothing secured in a rotationally-fixed manner on the second lever, at least one pawl pivotably mounted on the first lever and loaded in the direction of the toothing, which is engaged with the toothing in a catch position.

The clamping or catch mechanism furthermore comprises a control disk mounted so it is rotatable around the common axis, using which the at least one pawl can be disengaged from the toothing after running over the predetermined angle from the base position in an adjustment direction, so that when the pawl is disengaged from the toothing by running over the predetermined angle in a reset direction, the two levers are pivotable back into the base position.

The first control disk can be carried along by bearing in a friction-locked manner on the toothing and is mounted so it is rotatable by a switching angle in relation to the first lever.

A second control disk, mounted so it is rotatable around the common axis, can be carried along by the toothing and is mounted so it is rotatable by a switching angle in relation to the toothing.

Using such a pivot fitting, it is now made possible, even in the case of a pivot of the levers in relation to one another in the reset direction, to stop this pivot procedure in an intermediate position and latch the levers in a desired position, without the two levers first having to be pivoted back into the base position.

In addition, it is made possible to use a greater fraction of the adjustment distance as a catch distance, by the required distance for switching over being shortened.

According to a first advantageous embodiment variant, the toothing is formed as at least one at least partially-circular toothed pulley having outer toothing formed on a partially-circular outer border, which is coupled via a force shaft to the second lever. The pawl comprises a pivot arm having teeth facing toward the rotational axis of the levers.

According to one embodiment variant, the first control disk is formed as a disk spring or spring plate. Omitting the first spring element is thus enabled.

A control disk formed in this manner is producible cost-effectively and can be installed in a simple manner in the clamping mechanism and ensures a sufficient friction-locked contact of the first control disk on the toothing.

For the continuous application of force to the pawl, the clamping mechanism comprises a spring element, using which the at least one pawl can be pressed against the toothing.

For the movement of the first control disk in relation to the toothed pulley, it preferably comprises a recess in which a control bolt fastened on the first lever is accommodated. The recess is dimensioned in this case in such a way that the control bolt is displaceable by the switching angle in relation to the first control disk.

A switchover contour is preferably provided spaced apart from the recess on an outer circumference of the first control disk, using which the pawl is pivotable out of a catch position with the toothing into a non-catch position. In a catch position of the pawl, the switchover contour is engaged in the pawl adjacent to the teeth, which form an inner toothing, of the provided recess.

The edges of the pawl framing the recess are used in this case according to a further preferred embodiment variant as support surfaces for supporting the pawl on the switchover contour of the first control disk.

Keeping the pawl disengaged from the toothing during pivoting of the levers in relation to one another both in the adjustment direction and also in the reset direction is thus enabled.

According to one preferred embodiment variant, the switchover contour is formed in such a way that, during adjustment of the levers in relation to one another in the adjustment direction from a predetermined adjustment angle, the pawl is held disengaged from the toothing on a first support surface of the switchover contour.

This enables a silent adjustment during the adjustment of the levers in relation to one another in the adjustment direction, since the pawl does not engage with the toothing due to the support on the switchover contour and thus ensures a silent adjustment.

According to an alternative embodiment variant, the switchover contour is formed in such a way that the pawl is guided touching the toothing during adjustment of the levers in relation to one another in the adjustment direction.

This variant of the switchover contour enables an audible catching of the pawl during the adjustment in the adjustment direction.

In both variants, the desired catch position is slightly overrun in each case, so that upon loading of the pivot fitting and a relative pivot of the levers in the reset direction accompanying this, the pawl slips down from the switchover contour of the control disk and engages in the toothing.

According to a further embodiment variant, the toothing is integrally formed with the force shaft, in particular as a sintered part, wherein the two control disks are arranged laterally in relation to the toothed pulley.

The installation of the pivot fitting is thus facilitated.

It is also conceivable to form the toothing and the force shaft as separate components, wherein in this case the toothing is coupled in a rotationally-fixed manner to the force shaft.

According to a further preferred embodiment variant, the second control disk is formed as a ring disk having an oblong hole accommodating the common axis.

The second control disk preferably comprises a switching arm extending radially outward in the direction of the longitudinal extension of the oblong hole, which arm is accommodated in a recess formed on the circumferential border of the toothed pulley, wherein the recess is delimited in the adjustment direction by a first stop in the region of the outer toothing and in the reset direction by a second stop in the region of a protrusion adjoining the outer toothing.

A limited pivot movement of the second control disk in relation to the toothed pulley of the toothing is thus enabled in a simple manner. The recess and the stops delimiting it are producible in this case in particular in a simple manner in the variant of the toothing embodied as a sintered part.

A first stop surface of the switching arm facing toward the first stop and an outer flank of a border tooth formed at the free end of the pawl are formed according to a further embodiment variant in such a way that upon relative movement of the levers in the reset direction, the pawl can be pressed away from the outer toothing by the switching arm.

Disengaging the pawl from the toothing with only very small adjustment angle is thus enabled.

A front edge of the switching arm located on the radial outside protrudes radially outward beyond the outer toothing in a switchover position in this case.

According to a further embodiment variant, a ramp adjoining the radial displacement of the second control disk on a circular portion of the ring disk is formed on a portion of the second control disk remote from the switching arm.

This enables a displacement of the second control disk in a simple manner shortly before reaching the switchover position, wherein the control bolt fastened on the first lever is guided along this ramp and at the same time displaces the second control disk radially in such a way that the front edge of the switching arm located on the radial outside is advanced radially outward beyond the outer toothing.

In a further embodiment variant, the toothing and the two control disks are accommodated between lever heads of the cover, wherein the spring element is arranged between the lever heads, circumferentially enclosing the toothing and the control disk.

The spring element thus also enables, in addition to the contact pressure of the pawl, the protection of the toothing, the control disks, and the pawl from dirt, which further extends the service life of the pivot fitting.

The piece of furniture according to the invention is distinguished by an above-described pivot fitting fastened thereon.

BRIEF DESCRIPTION OF THE DRAWING FIGURES

Figure 2:
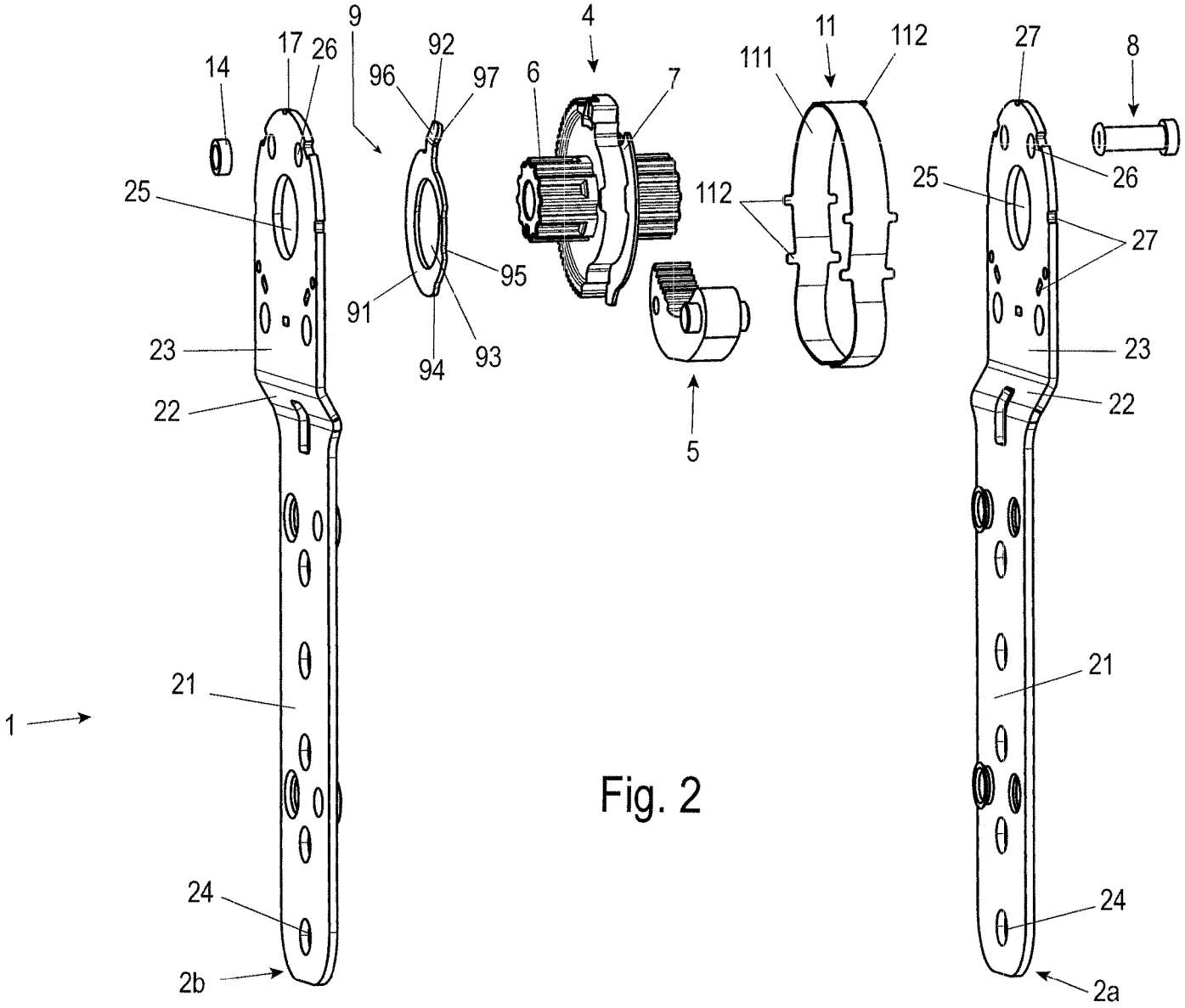
Figure 3A:
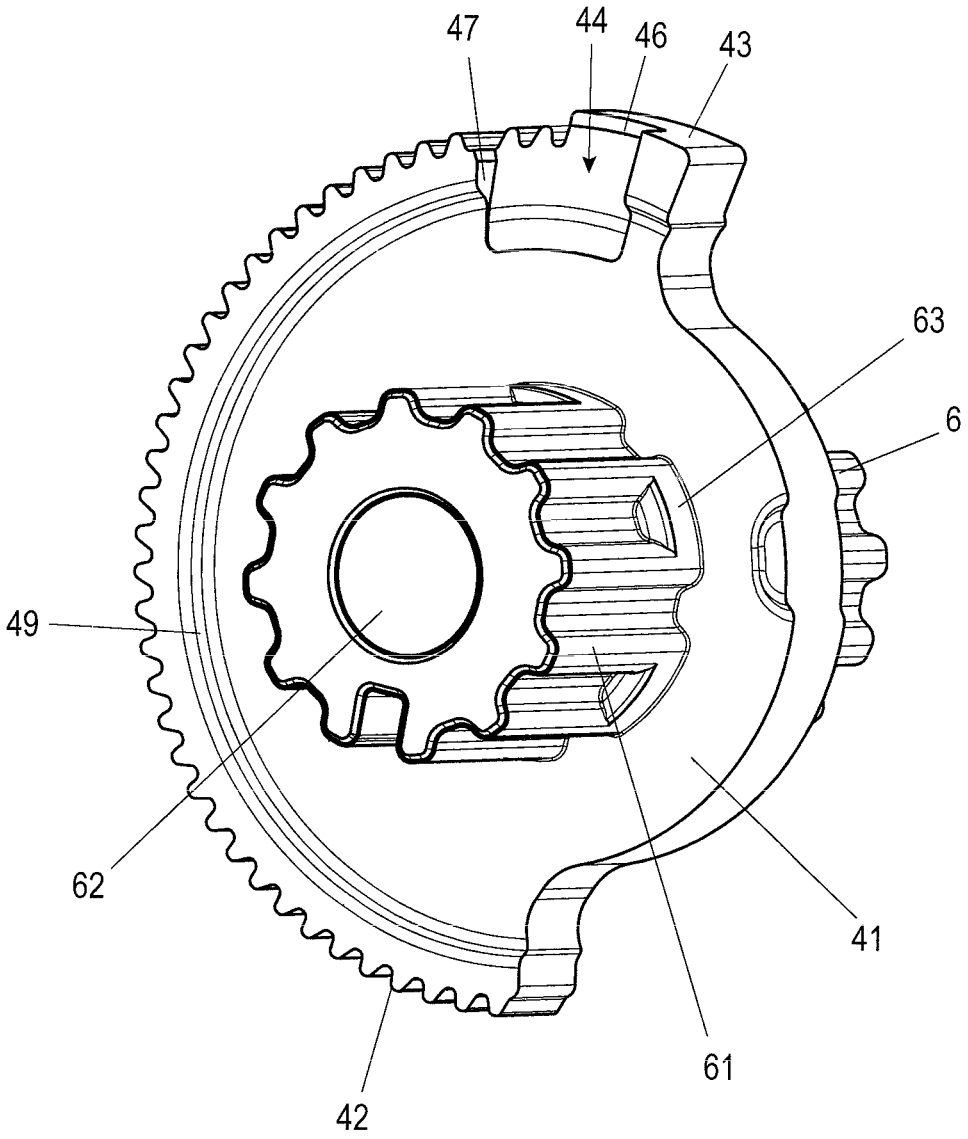
Figure 3B:
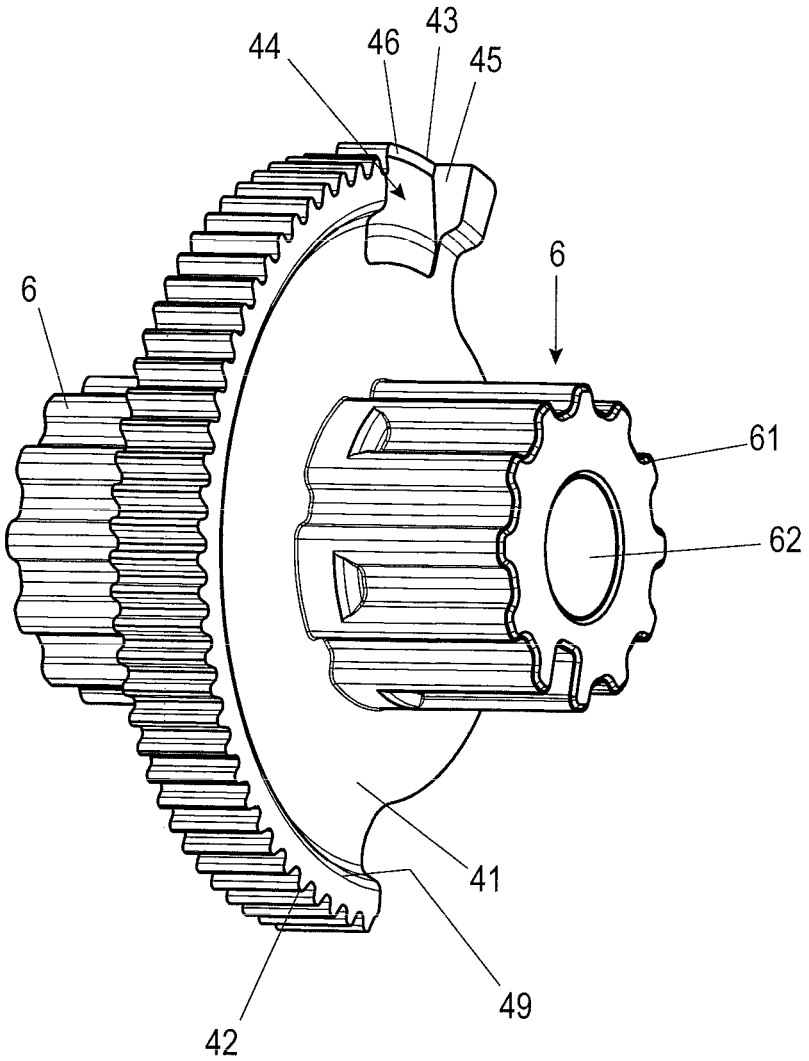
Figure 4:
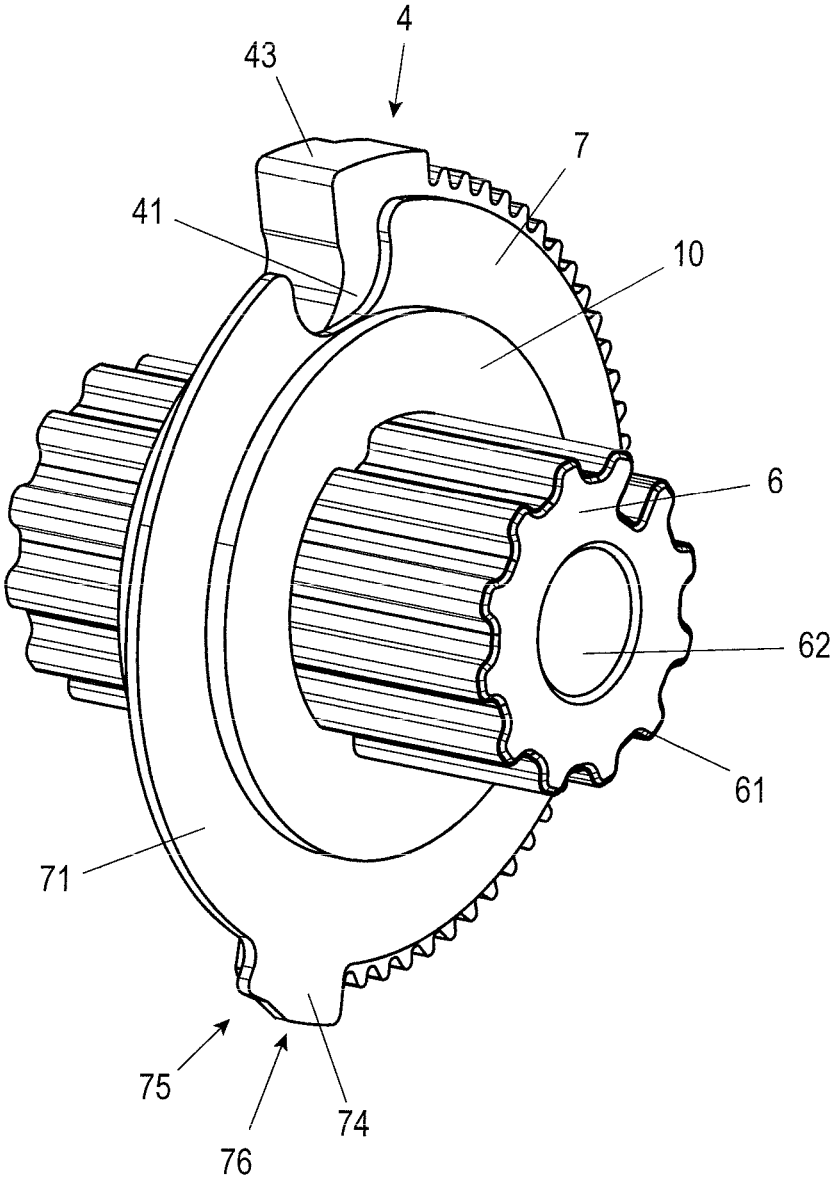
Figure 5:
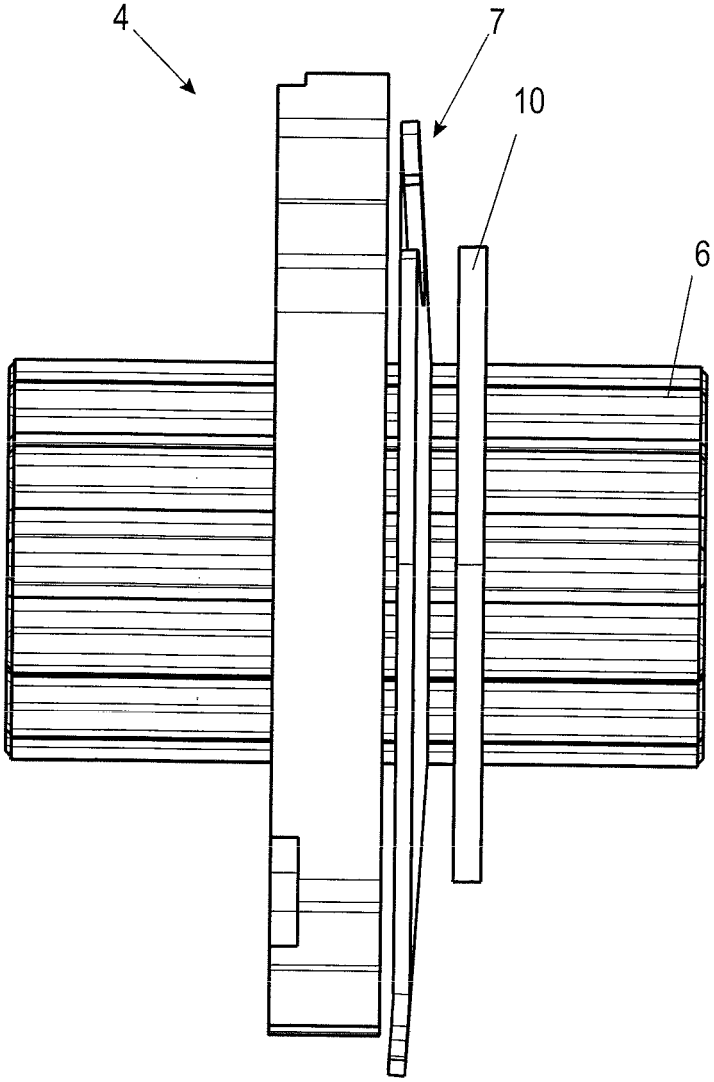
Figure 6:
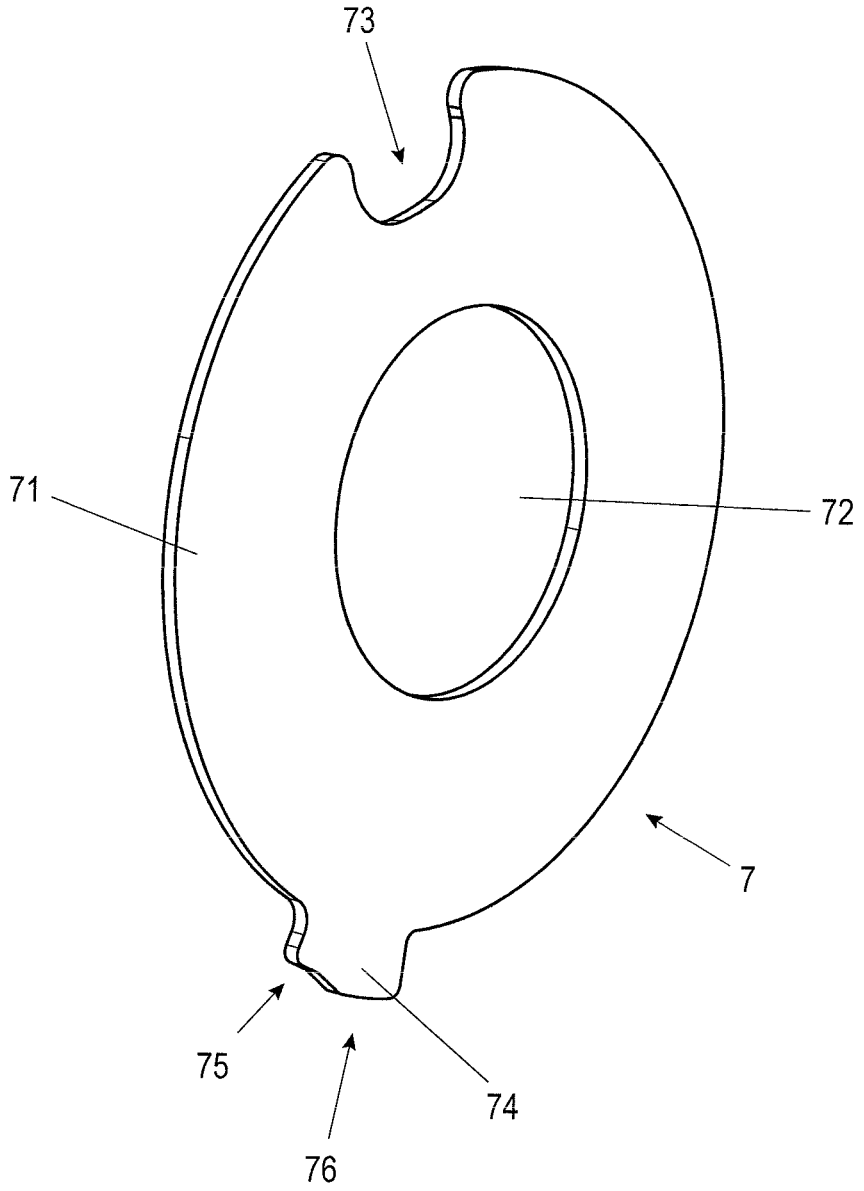
Figure 7:
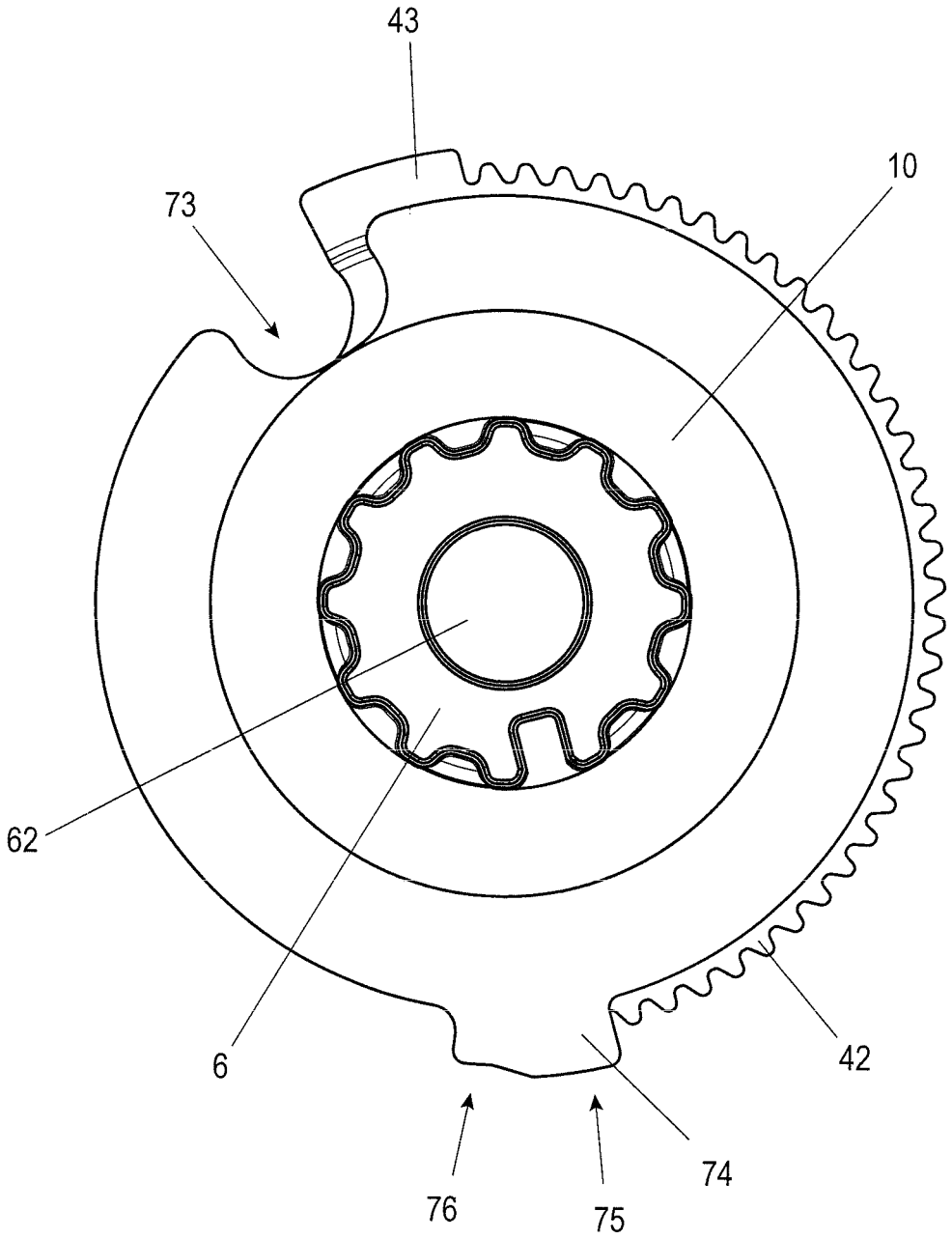
Figure 8:
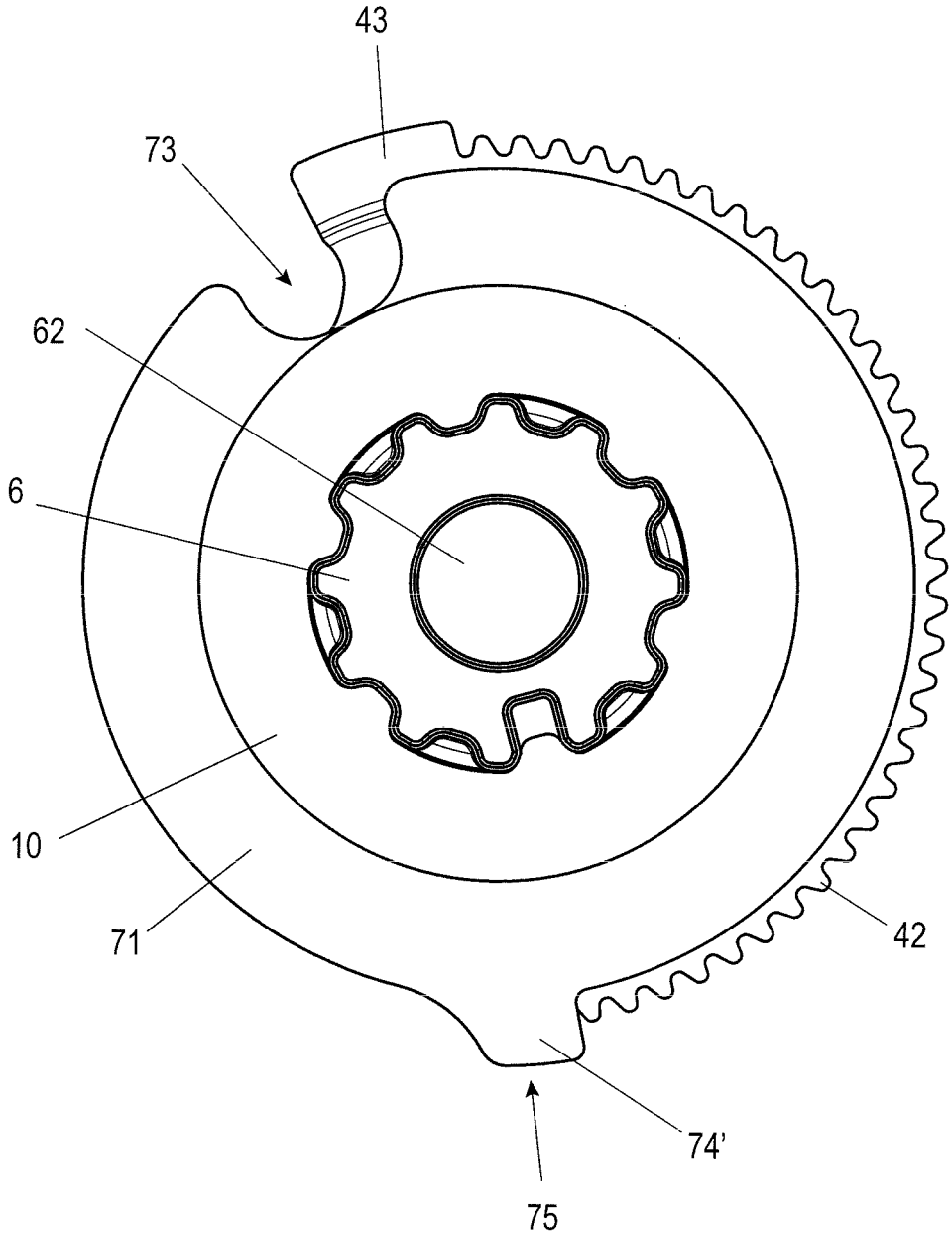
Figure 9:
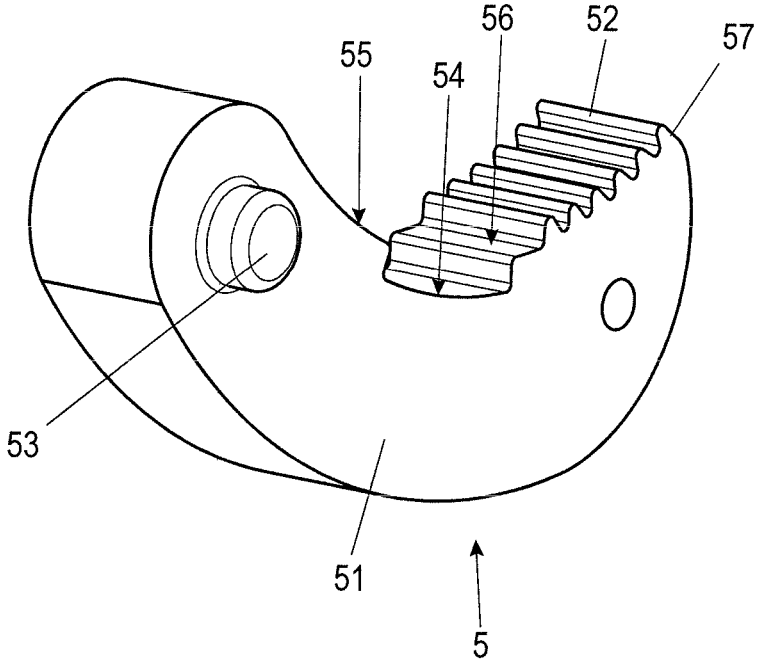
Figure 10:
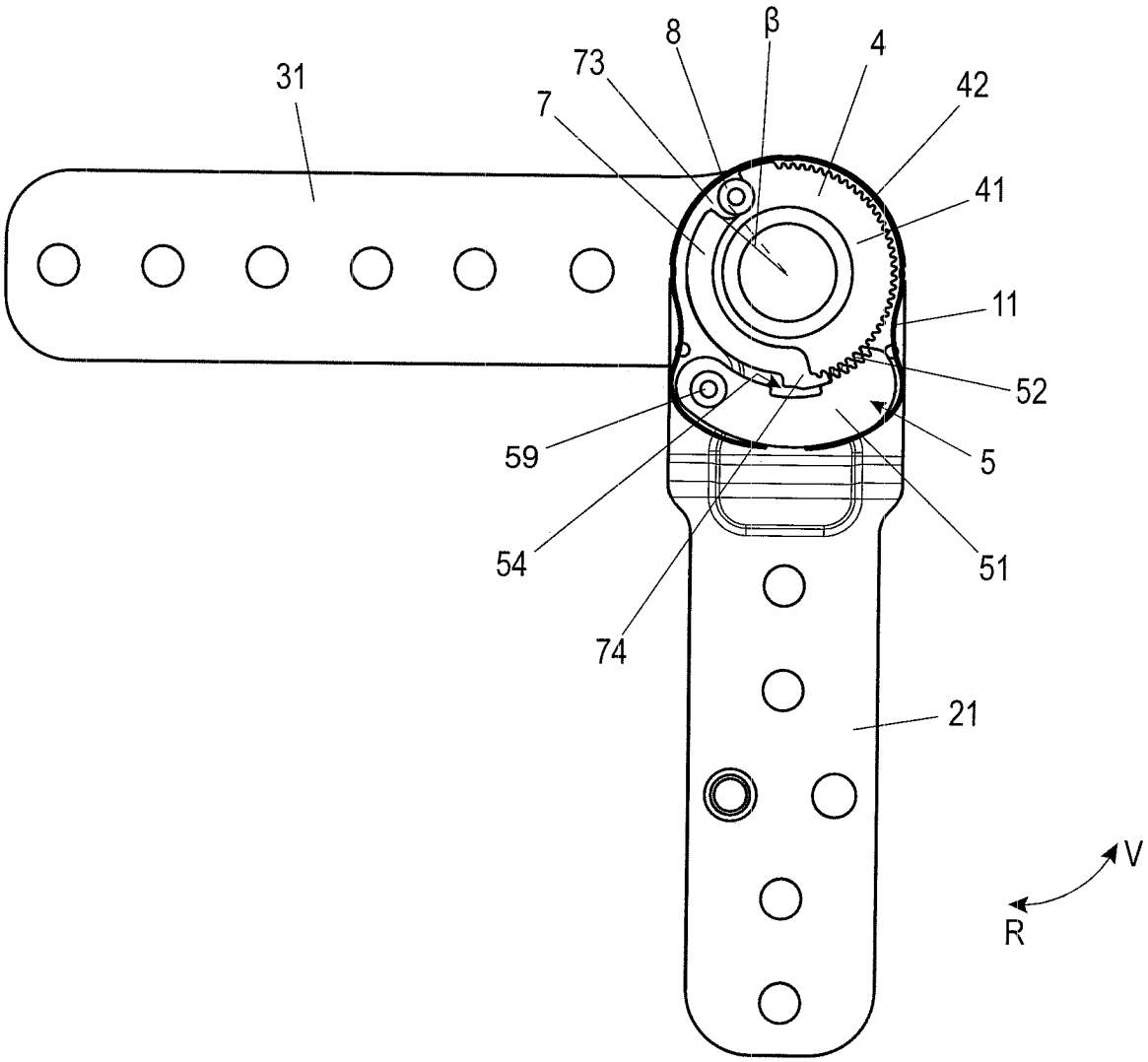
Figure 11:
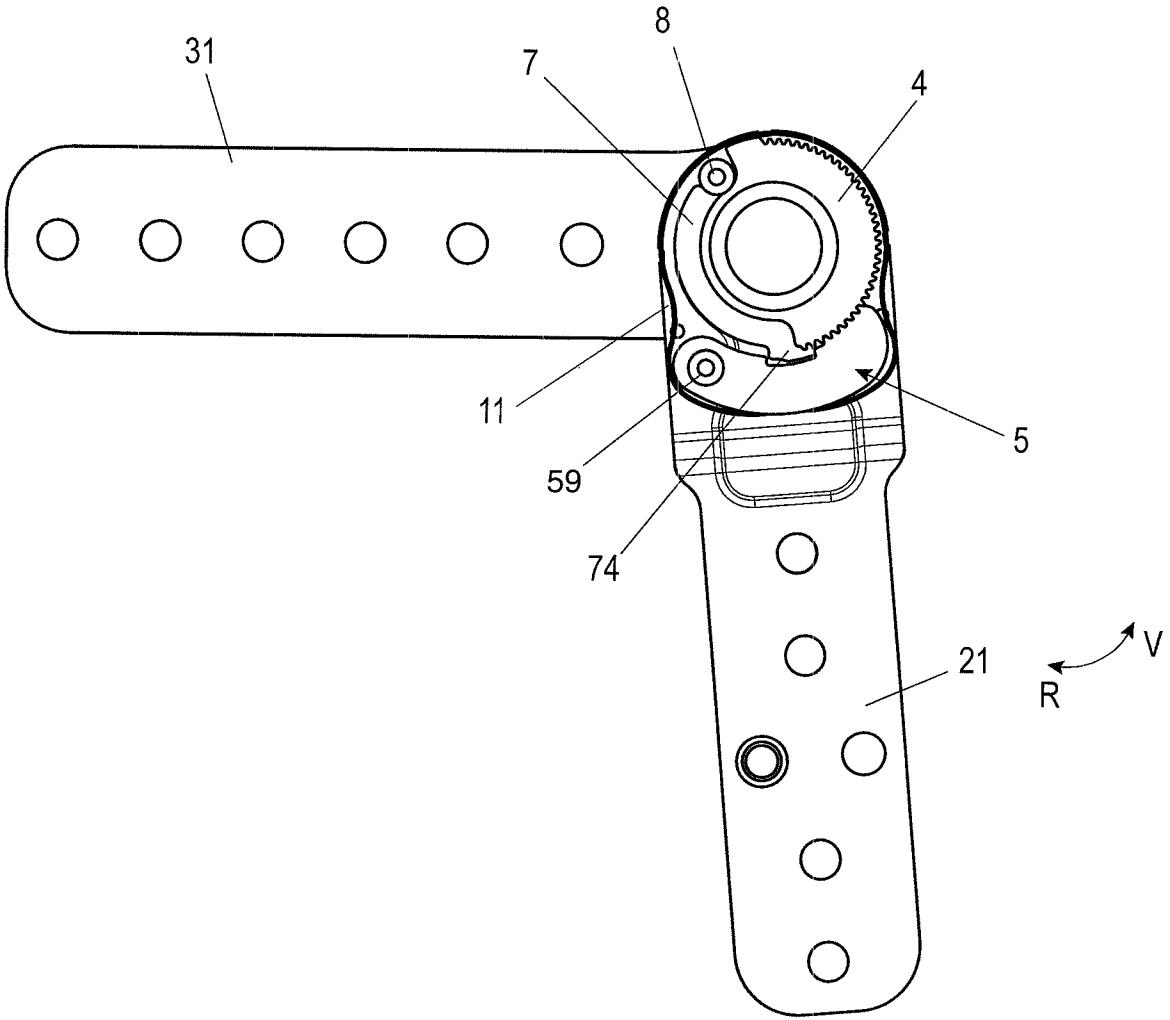
Figure 12:
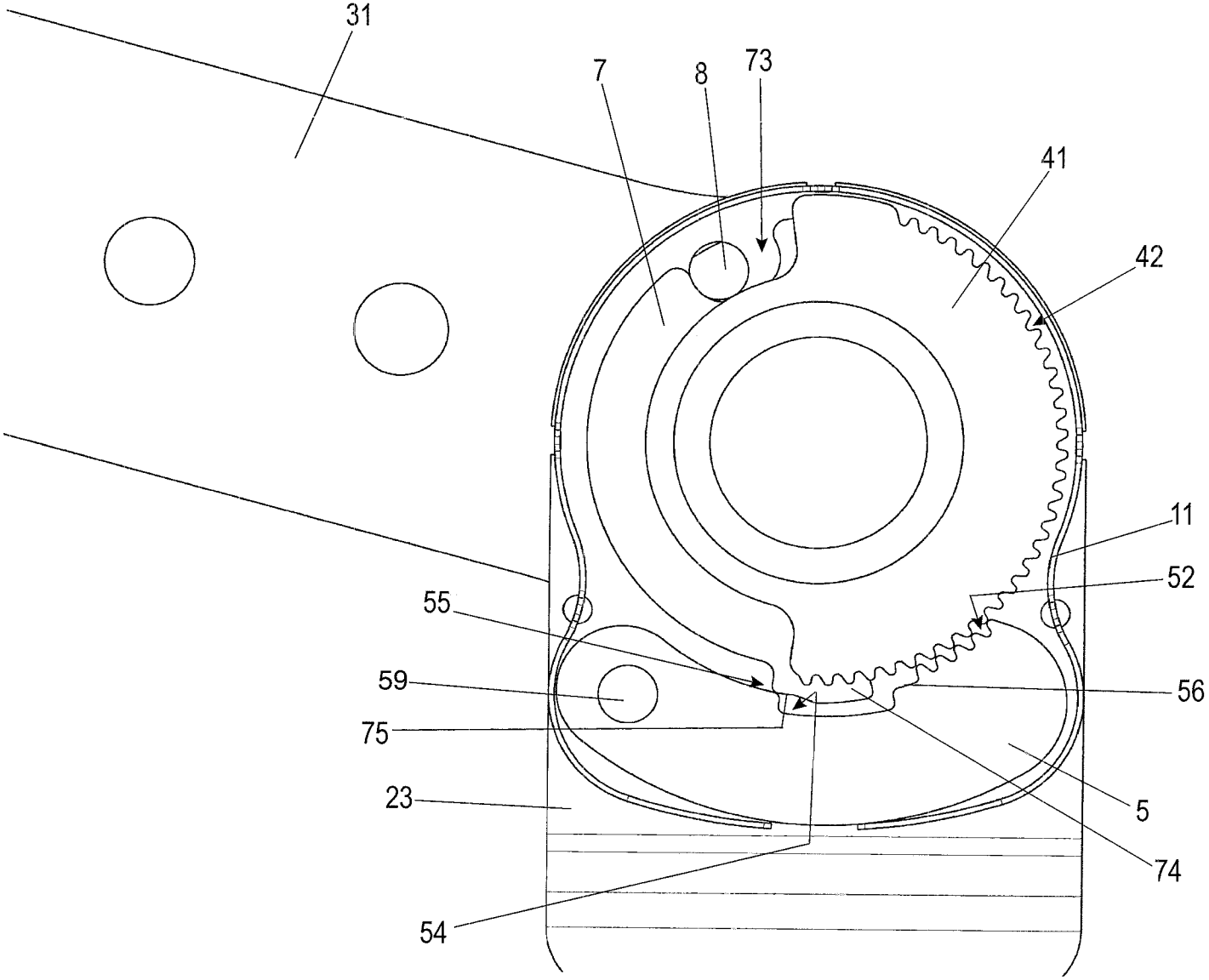
Figure 13:
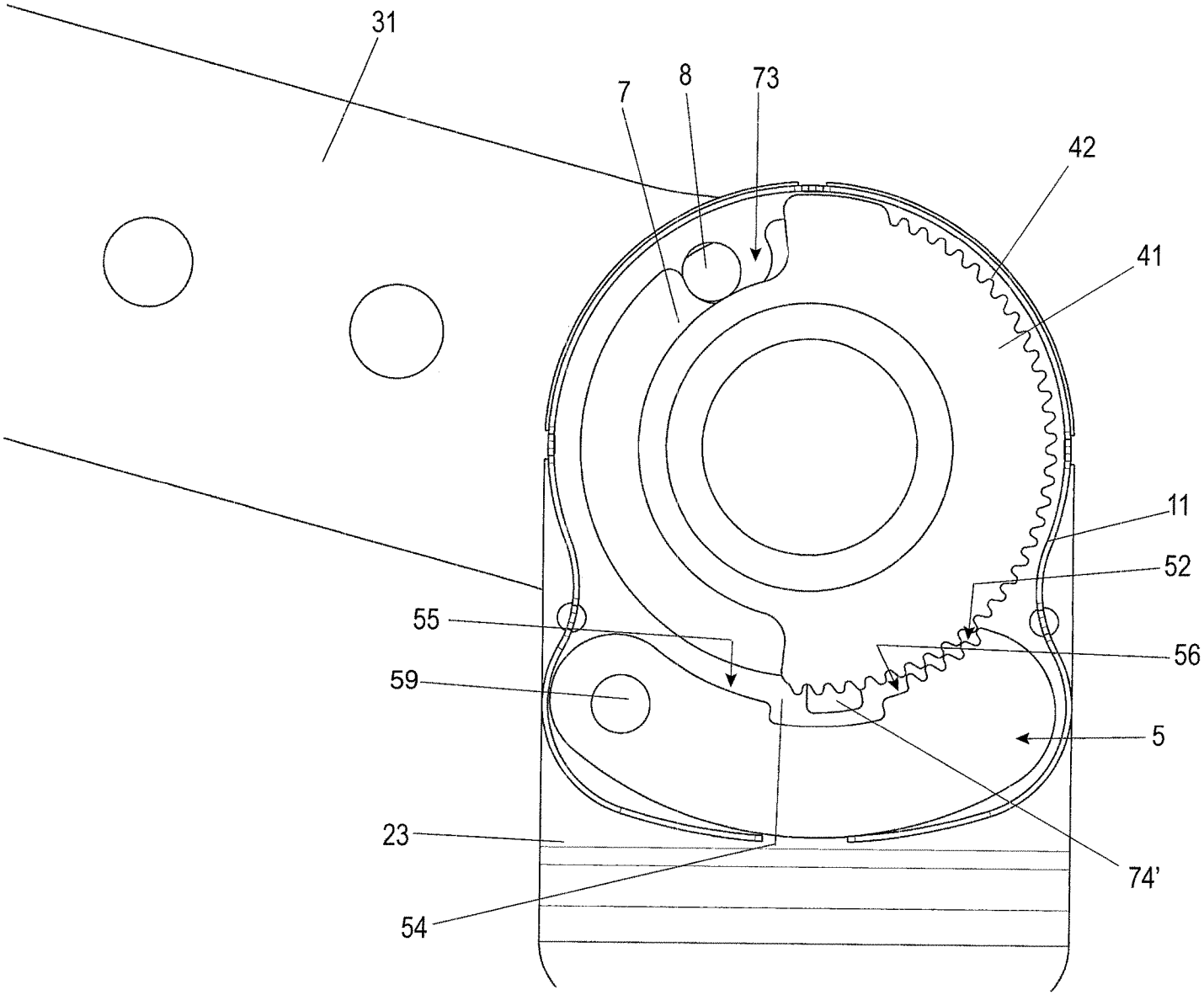
Figure 14:
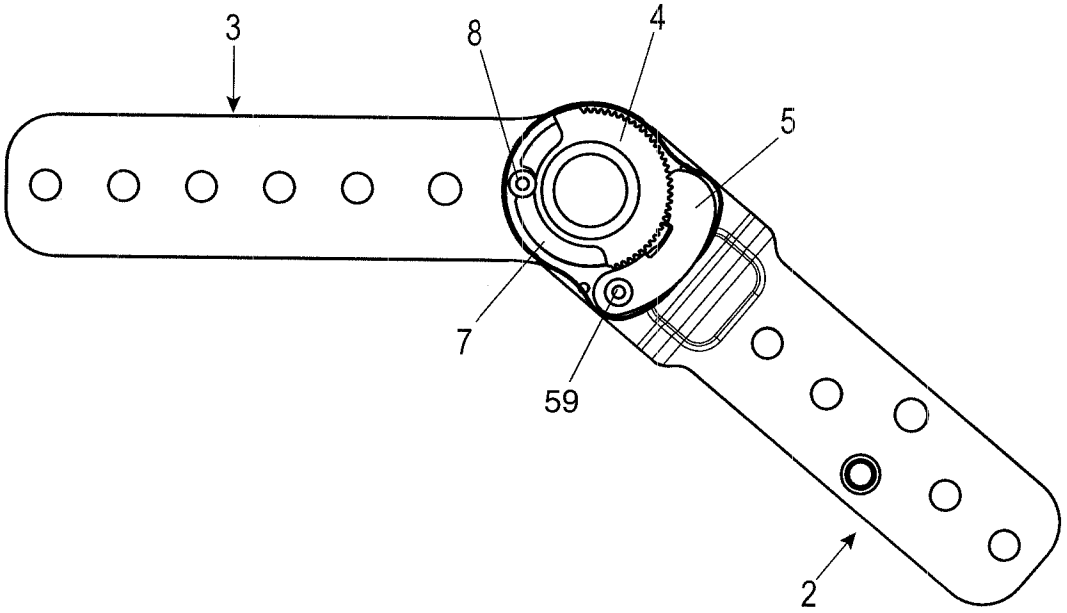
Figure 15:
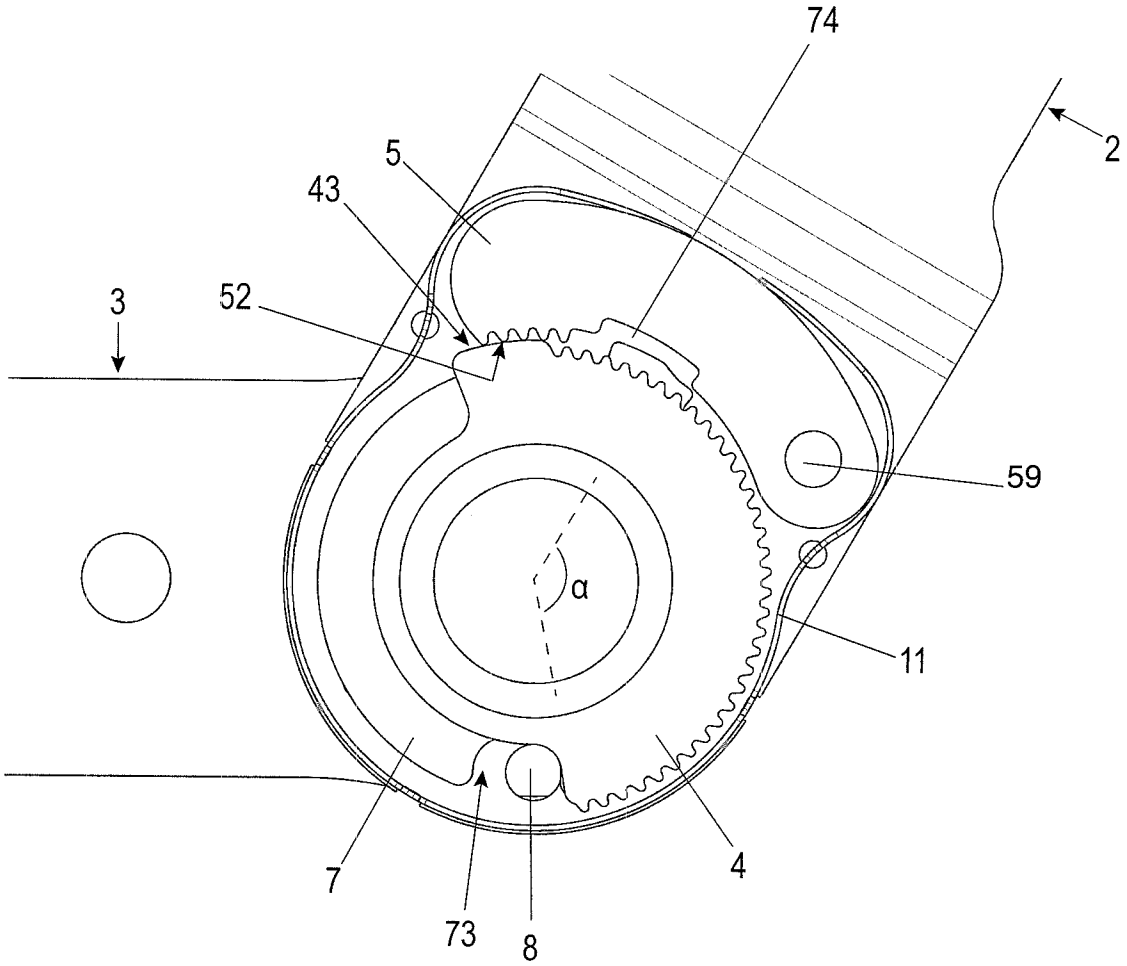
Figure 16:
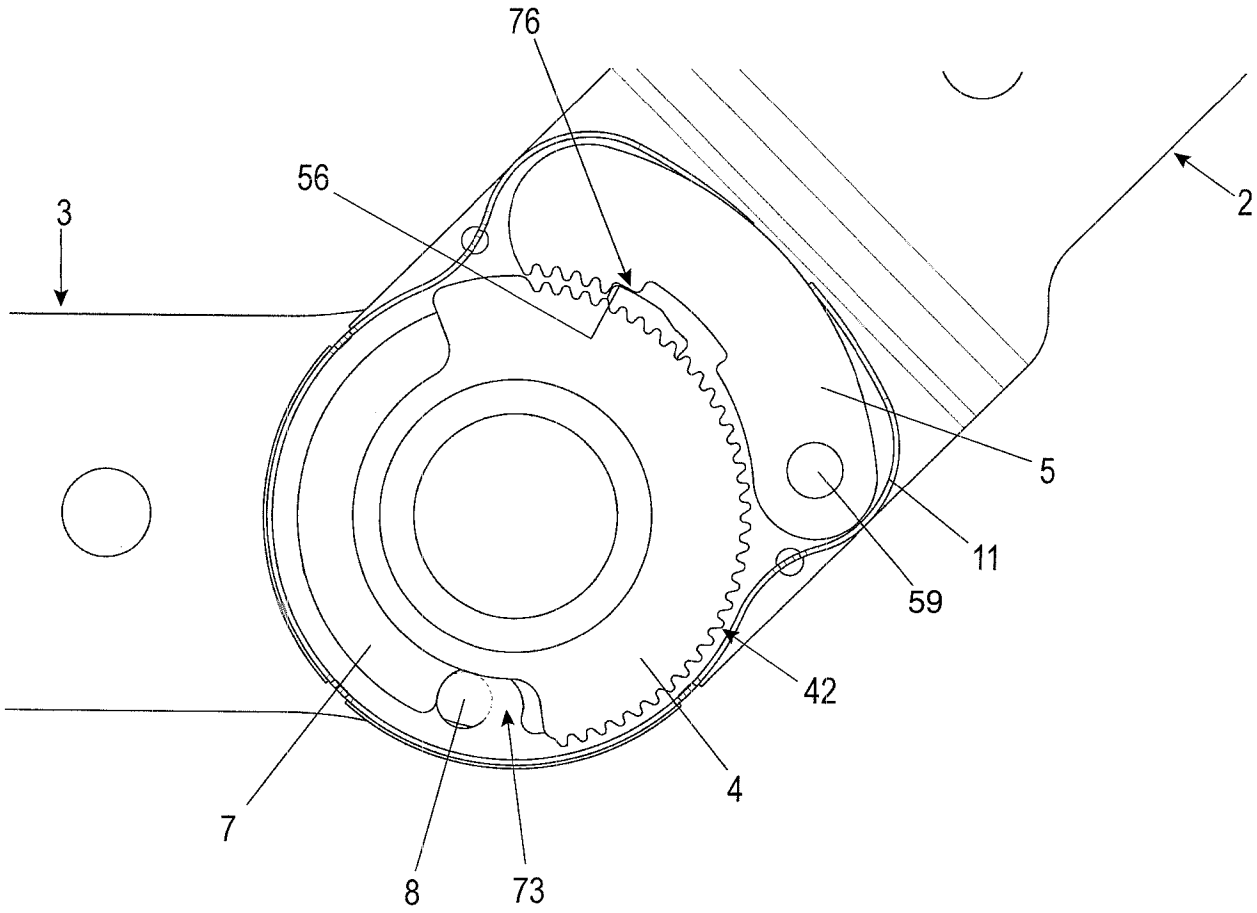
Figure 17:
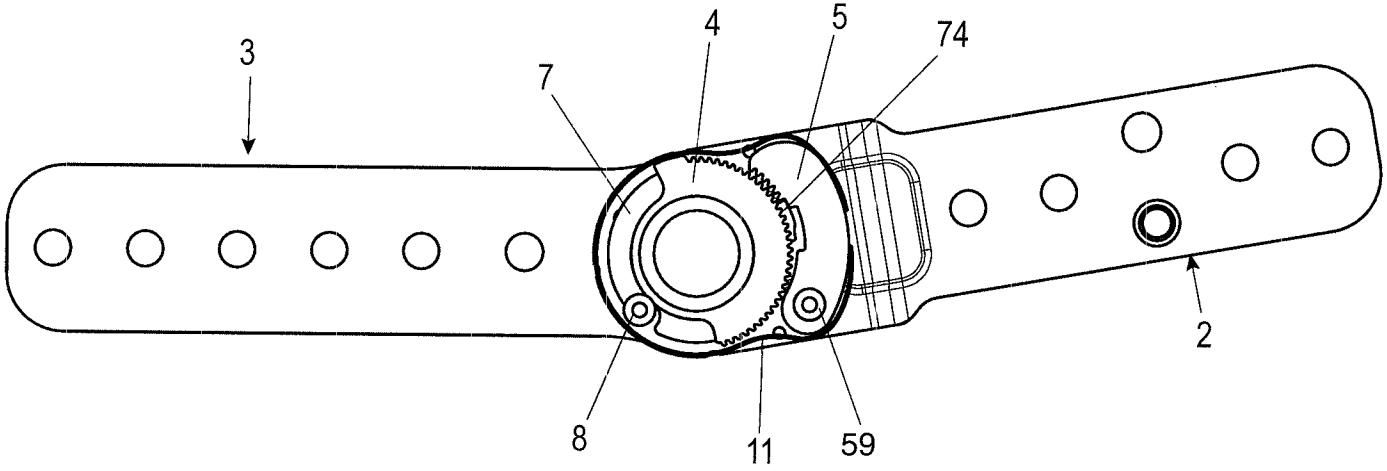
Figure 18:
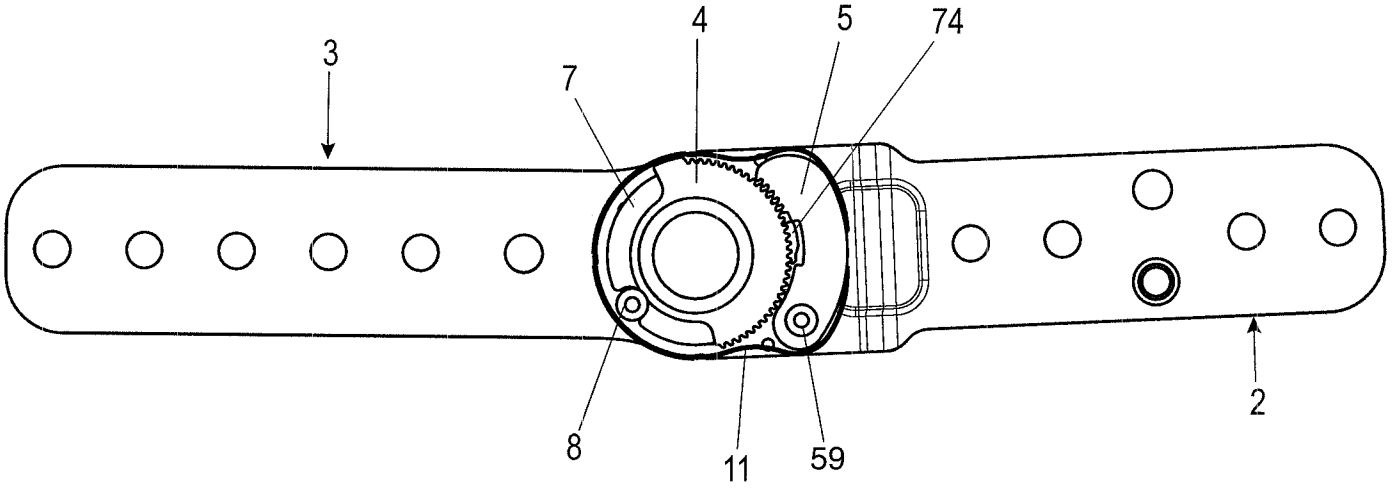
Figure 19:
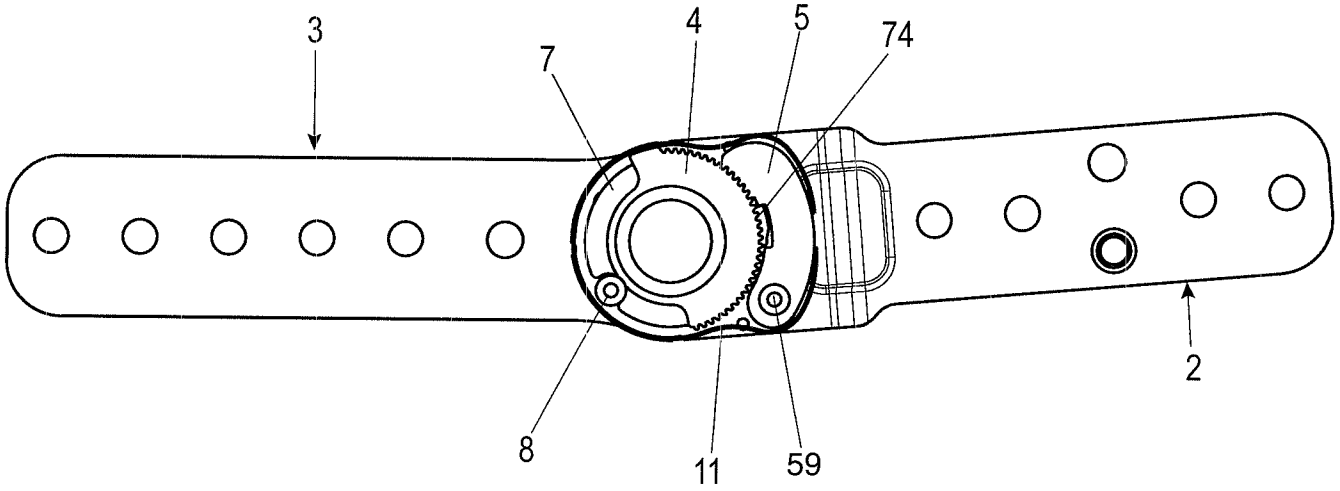
Figure 23:
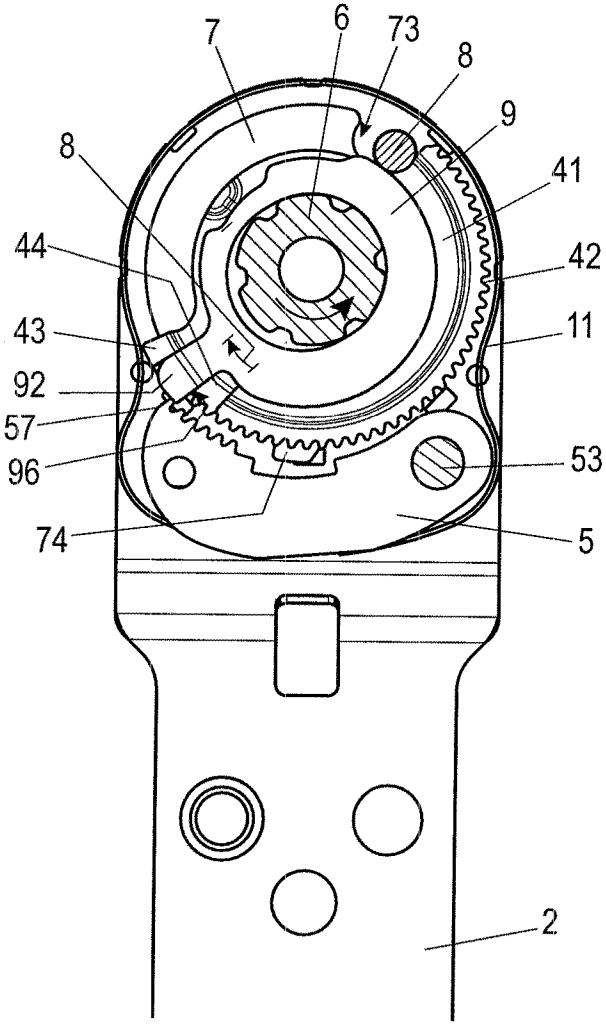
Figure 25:
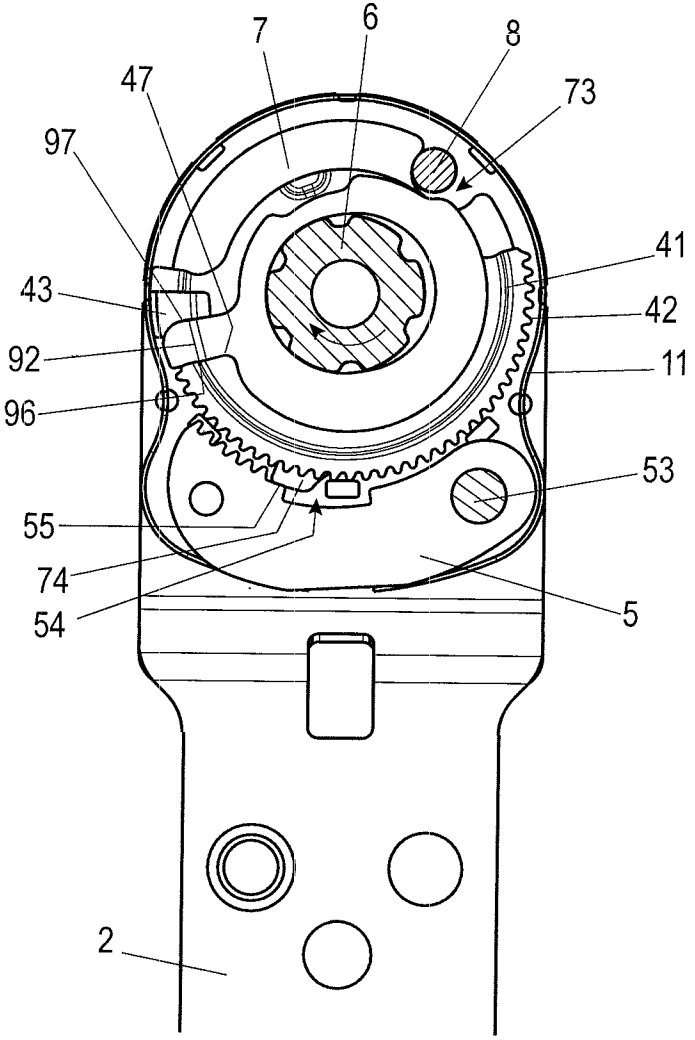
Figure 24:
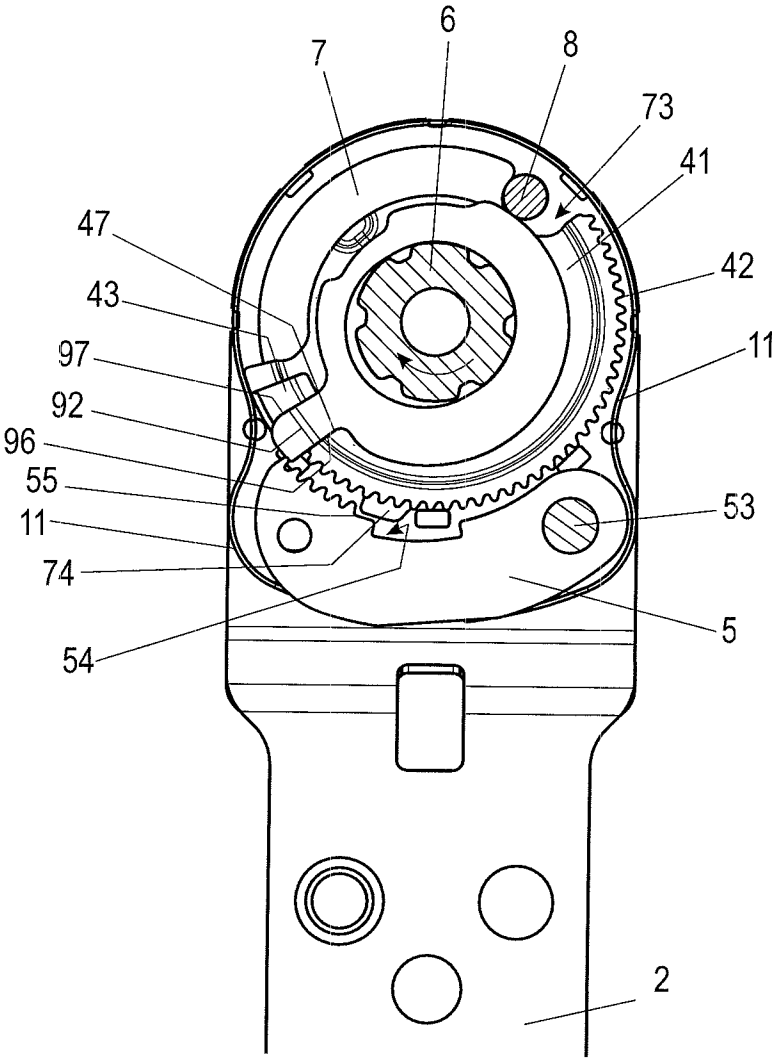
Figure 26:
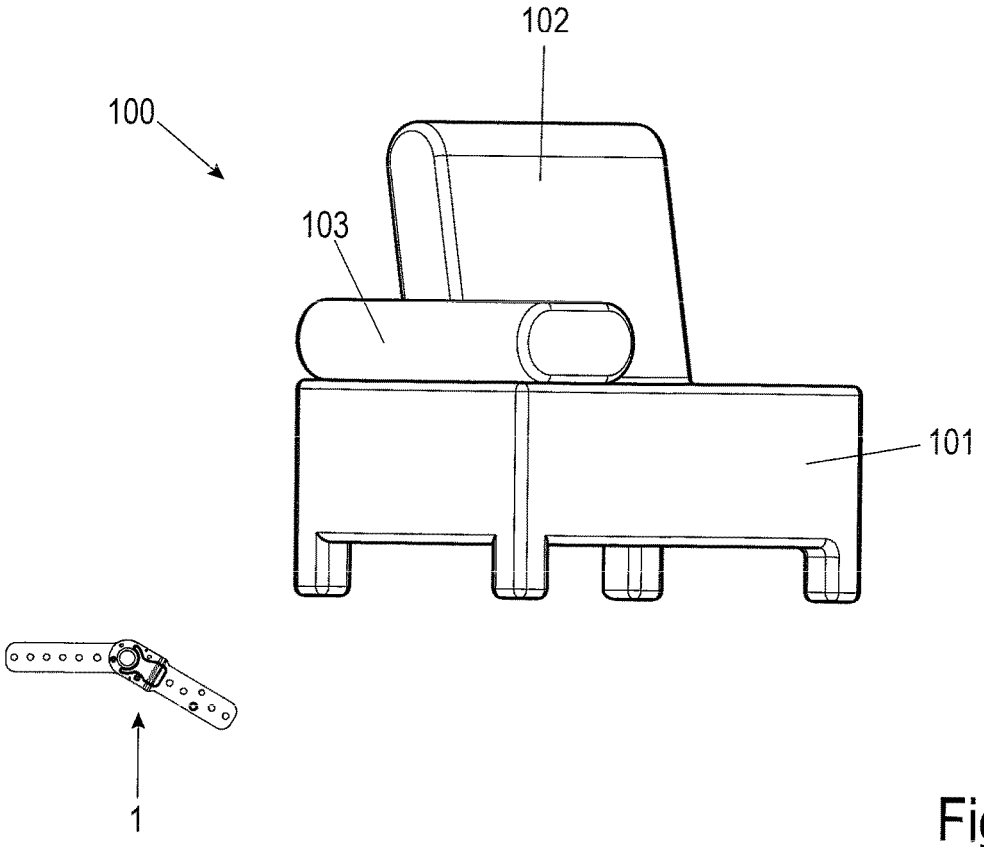
Figure 27:
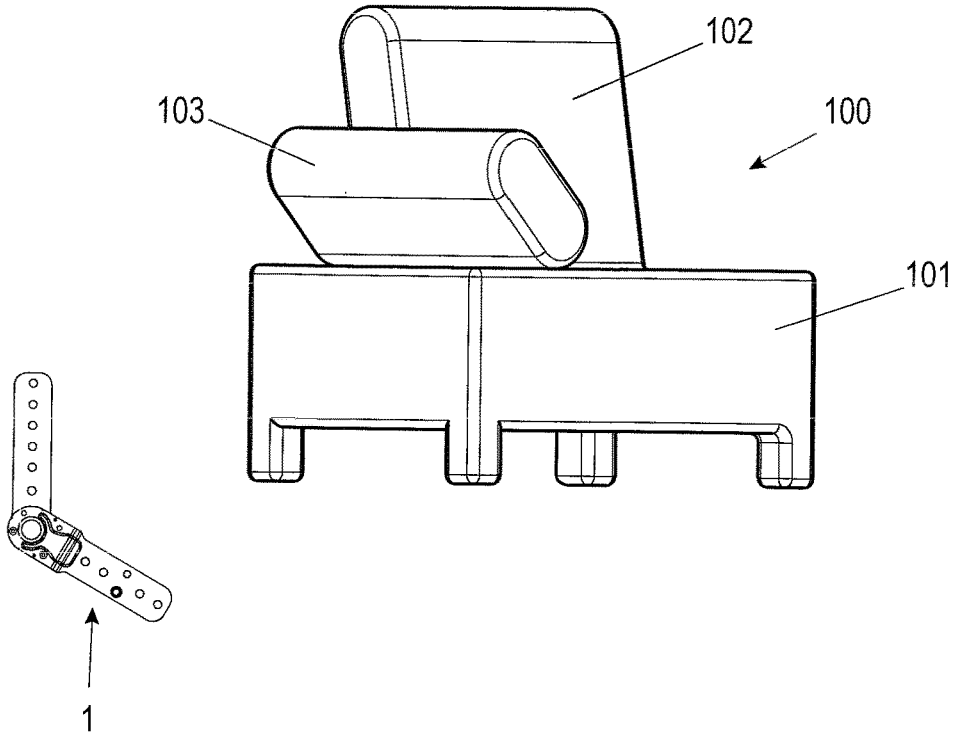
Figure 28:
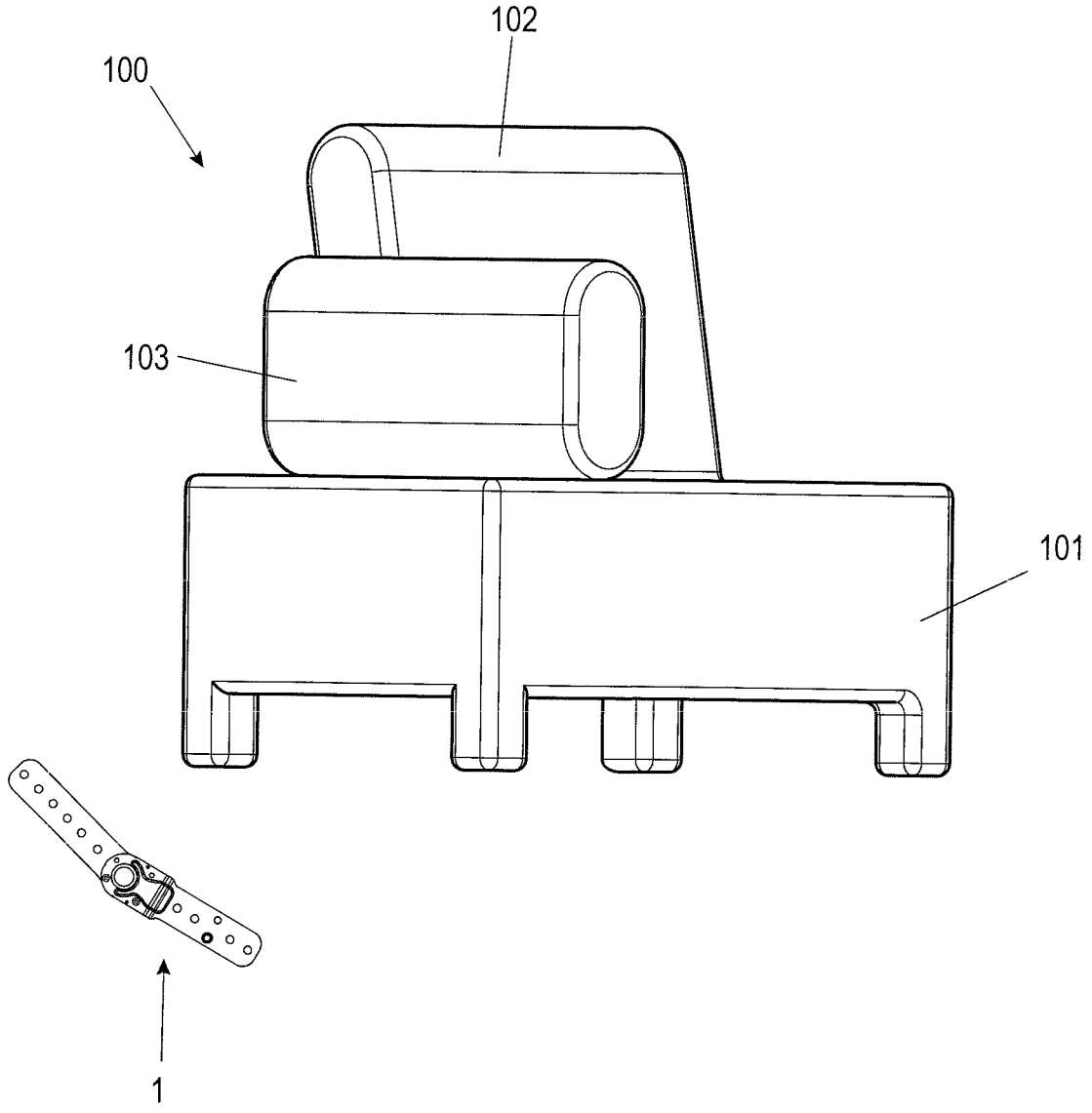

Exemplary embodiments of the invention are explained hereafter on the basis of the appended drawings. In the figures:

FIG. 1 shows a top view of a first embodiment variant of a pivot fitting according to the invention, FIG. 2 shows a perspective exploded illustration of the pivot fitting without illustration of the second lever, FIGS. 3*a, b* shows a perspective view of an embodiment variant of the toothing, FIG. 4 shows a perspective view of the toothing according to FIGS. 3*a* and 3*b* having first control disk arranged thereon, FIG. 5 shows a side view of the toothing according to FIGS. 3*a* and 3*b* having first control disk arranged thereon, FIG. 6 shows a perspective view of the first control disk, FIG. 7 shows a top view of the first control disk according to FIG. 6, installed on the toothing, FIG. 8 shows a top view of an alternative embodiment variant of the first control disk, installed on the toothing, FIG. 9 shows a perspective view of an embodiment variant of the pawl, FIG. 10 shows a schematic top view of the pivot fitting according to FIG. 1 having omitted first cover in a base position, FIG. 11 shows an illustration of the pivot fitting corresponding to FIG. 10 in a first catch position, FIG. 12 shows an enlarged view of a detail of the pivot fitting according to FIG. 10 with levers pivoted further in the adjustment direction having pawl disengaged from the toothing, FIG. 13 shows an illustration corresponding to FIG. 12 having alternative embodiment variant of the control disk, in which the pawl slides from one catch position into the next catch position upon adjustment of the levers in relation to one another in the adjustment direction, FIG. 14 shows a top view corresponding to FIG. 10 in a catch position, FIG. 15 shows a top view of the pivot fitting according to FIG. 10 in the switchover position, in which the two levers are pivoted in relation to one another out of the base position by the entire possible angle, FIG. 16 shows an illustration of the pivot fitting corresponding to FIG. 10 during a pivot in the reset direction, FIG. 17 shows an illustration of the pivot fitting corresponding to FIG. 10 in a position before switching over the movement direction of the levers in relation to one another in the adjustment direction, FIGS. 18, 19 show illustrations of the pivot fitting corresponding to FIG. 10 during the movement in the adjustment direction or load direction to reach the catch position shown in FIG. 19, FIGS. 20 to 23 show top views of the rear side of the pivot fitting according to FIG. 10 during movement in the adjustment direction before or upon reaching the switchover position, respectively, FIGS. 24, 25 show top views of the rear side of the pivot fitting according to FIG. 10 during movement in the reset direction after reaching the switchover position, FIGS. 26 to 28 show perspective illustrations of a piece of furniture having armrest in different catch positions.

DETAILED DESCRIPTION

In the following description of the figures, terms such as upper, lower, left, right, front, rear, etc. relate exclusively to the exemplary illustration and position of the pivot fitting, the levers, the toothing, the pawl, the control disk, and the like selected in the respective figures. These terms are not to be understood as restrictive, i.e., these references can change due to different operating positions or mirror-symmetrical design or the like.

A piece of furniture, designed by way of example here as a piece of upholstered furniture, which is designed here as a piece of seating furniture, in particular as an armchair, is identified in FIGS. 26 to 28 with the reference sign 100, having a furniture body 101, a backrest 502, and an armrest or headrest 103. The armrest or headrest 503 is fastened on the furniture body 101 so it can be latched in different positions in this case.

A pivot fitting, which is provided here with the reference sign 1, is used in this case for the adjustment, using which it is made possible to adjust the armrest or headrest 103 from the base position shown in FIG. 26 via the angled position shown in FIG. 27 into the upright position shown in FIG. 28 and to latch it in these respective positions.

Using the pivot fitting 1, for which various embodiment variants of pivot fittings are described hereafter, it is additionally made possible to adjust this armrest or headrest 103 from the position shown in FIG. 28 back into the position shown in FIG. 27, without first having to pivot back the armrest or headrest 103 into the base position shown in FIG. 26.

Embodiment variants of a pivot fitting suitable for such an adjustment are described hereafter on the basis of FIGS. 1 to 26.

The pivot fitting 1 comprises a first lever 2 and a second lever 3, which are mounted so they are pivotable in relation to one another around a common axis D out of a base position by a predetermined angle α.

The pivot fitting 1 furthermore comprises a clamping mechanism, using which the two levers 2, 3 are fixable in relation to one another in different angular positions within the predetermined angle α.

The clamping mechanism comprises a toothing 4 secured in a rotationally-fixed manner on the second lever 3 and also at least one pawl 5, which is mounted so it is pivotable on the first lever 2 and is loaded in the direction of the toothing 4, and which is engaged with the toothing 4 in a catch position.

The clamping mechanism additionally comprises a first control disk 7 mounted so it is rotatable around the common axis D, using which the at least one pawl 5, after running over the predetermined angle α from the base position in an adjustment direction V, can be disengaged from the toothing 4, so that that if the pawl 5 is disengaged from the toothing 4 by running over the predetermined angle α in a reset direction R, the two levers 2, 3 are pivotable back into the base position.

The first control disk 7 is drivable by a bearing in a friction-locked manner on the toothing 4 in this case and is mounted so it is rotatable by a pivot angle β in relation to the first lever 2.

The first lever 2 consists of two substantially structurally-equivalent covers here, namely a first cover 2*a* and a second cover 2*b*.

Each of these covers 2*a*, 2*b* comprises a lever arm 21, which merges via a bent region 22 into a lever head 23. A circular receptacle 25, which is used to guide through a force shaft 6 having polygonal lateral surface, is provided in the lever head 23.

The toothing 4 and also the first control disk 7 and a second control disk 9 are accommodated between the lever heads 23 of the first cover 2*a* and the second cover 2*b*. In this embodiment variant, the toothing 4 comprises a toothed pulley 41 integrally formed with the force shaft 6, in particular as a sintered part.

The force shaft 6 is formed here for the rotationally-fixed connection to the second lever 3 using, for example, a polygonal outer contour 61.

The force shaft 6 furthermore comprises a receptacle 62, in which a central bolt 12 is accommodated, using which the two levers 2, 3 are axially fixed on one another.

The toothed pulley 41 has, as shown in FIGS. 2 to 4, an outer toothing 42 formed on a partially-circular outer border.

The pawl 5 used for latching with the toothing 4 is, as can be seen in FIGS. 2 to 9, mounted so it is pivotable on the first lever 2 via a pawl bolt 59, which is formed here on the pawl.

It is also conceivable to form the pawl bolt as a separate component, which would then be accommodated in a bearing borehole 53 of the pawl 5. The pawl bolt 59 extends in this case between the two lever heads 23 of the first cover 2*a* and the second cover 2*b*.

The first control disk 7, as shown in FIGS. 4 to 6, is formed as a disk spring or spring plate, which is arranged laterally on the toothed pulley 41 of the toothing 4.

A ring disk 10 pushed onto a part of the force shaft 6 presses the first control disk 7 with pre-tension against the toothed pulley 41 of the toothing 4. To fasten this ring disk 10 on the part of the force shaft 6, the ring disk 10 is pressed, for example, like a shaft retainer with a press fit onto the outer contour 61 of the force shaft 6. Other types of fastening the ring disk 10 on the force shaft 6 are also conceivable, for example, welding, pressing on, or the like. The ring disk 10 comprises tongues extending radially inward from a ring-shaped base body for the rotation lock in relation to the force shaft 6, as shown in FIG. 4.

A top view of an embodiment variant of the first control disk 7 is shown in FIGS. 6 and 7. The control disk 7 essentially consists in this case of a ring 71 having a central recess 72, through which the force shaft 6 extends in the installed state, but is not coupled thereto in a rotationally-fixed manner.

The control disk 7 comprises an opening 73 on an outer circumference, in which a control bolt 8 extending on the first lever 2, here between the lever heads 23 of the first cover 2*a* and the second cover 2*b*, is accommodated. The opening 73 is dimensioned in this case in such a way that the control bolt 8 is displaceable by the switching angle β in relation to the control disk 7.

In the embodiment variant shown here, the width of the opening 73 in the circumferential direction is accordingly greater than the diameter of the control bolt 8. The width of this opening 73 is dimensioned in this case in such a way that the control disk 7 is displaceable by the switching angle β in relation to the control bolt 8.

In order to always press the pawl 5 in the direction of the outer toothing 42 of the toothing 4, a spring element 11 is provided, which is arranged between the lever heads 23 of the first cover 2*a* and the second cover 2*b* and circumferentially encloses the intermediate space.

The two lower ends of this second spring element 11, which is formed here as a leaf spring and is also used to cover the intermediate space between the lever heads 23 of the first cover 2*a* and the second cover 2*b*, are bent over in this case in the direction of the pawl 5 and thus continuously press the pawl 5 in the direction of the outer toothing 42 of the toothed pulley 41.

The second control disk 9 is preferably arranged on the side of the toothed pulley 41 opposite to the first control disk 7.

As shown in FIG. 2 and FIGS. 20 to 25, the second control disk 9 preferably comprises a ring disk 91 having an oblong hole 93 accommodating the common axis D. The part of the force shaft 6 protruding on this side of the toothed pulley 41 is pushed into the oblong hole 93.

The outer toothing 42 of the toothed pulley 41 protrudes axially slightly beyond the lateral surface of the toothed pulley 41 on this side of the toothed pulley 41. The second control disk 9 is inserted into this depression in the installed position in this case.

The width of the ring of the ring disk 91 varies in this case over the circumference, so that by way of contact of the ring disk on the control bolt 8 during a pivot procedure of the pivot fitting 1, a radial displacement of the second control disk occurs depending on the width of the ring disk.

A protrusion 43, which extends radially beyond the outer toothing 42, having a recess 44 for accommodating a switching arm 92 of the second control disk 9 extending radially outward in the direction of the longitudinal extension of the oblong hole 93, is formed on a first end of the outer toothing 42.

The recess 44 extends in this case over a partial angle range of the protrusion 43 and a part of the outer toothing 42. The recess is delimited in this case in the adjustment direction V by a first stop 47 in the region of the outer toothing 42. In the reset direction R, the recess 44 is delimited by a second stop 45 in the region of the protrusion 43 adjoining the outer toothing 42.

This enables a limited pivot movement of the second control disk 9 in relation to the toothing 4 over a switching angle γ.

The oblong hole 93 of the second control disk 9 thus enables the second control disk 9 to be radially displaced in relation to the force shaft.

On a portion remote from the switching arm 92, a ramp 94 is formed on the outer border of the ring disk 91, so that when traveling down the ramp 94 due to the contact of the control bolt 8, a radial displacement of the ring disk 91 occurs, whereby a front edge located on the radial outside of the switching arm 92 is moved from a position radially inside the outer toothing 42 into a position protruding radially outside the outer toothing 42.

The function of the pivot fitting 1 will be described hereafter on the basis of FIGS. 10 to 25.

A base position of the pivot fitting 1 having exposed clamping mechanism is shown in this case in FIG. 10.

In the movement sequence shown in FIGS. 10 and 19, the second lever 3 is fixed in place, while the first lever 2 is pivoted in relation to the second lever 3 in an adjustment direction V (counterclockwise in FIG. 10) for adjustment to its base position shown in FIG. 10.

A movement of the first lever 2 in relation to the second lever 3 opposite to the adjustment direction V is denoted as the reset direction R.

As shown in FIG. 10, in the base position, the control disk 7 is positioned in such a way that a second support surface 76 of a switchover contour 74 of the control disk 7 rests on a second support surface 56 of the pawl 5, whereby the teeth 52 of the pawl 5 are disengaged from the toothing 4.

In this position, the control bolt 8 bears on a right lateral border of the opening 73 of the control disk 7.

If the first lever 2 is now pivoted in the adjustment direction V in relation to the second lever 3, the control bolt 8 is thus moved in the opening 73 of the control disk 7 away from the right lateral border in the direction of the left lateral border.

At the same time, the pawl 5, which is fastened via the fixing bolt 59 so it is fixed in place but is pivotable on the first lever 2, is moved in the adjustment direction V. The switchover contour 74 thus slips down from the second support surface 56 of the pawl 5 and plunges into the recess 54 of the pawl 5.

In this case, the pawl 5 is pressed by means of the second spring element 11 into the outer toothing 42 of the toothing 4 in a first catch position. Reaching this first catch position is audible due to the striking of the pawl 5 on the toothing 4. This first catch position preferably occurs in this case upon a pivot of the first lever 2 in relation to the second lever 3 by 5°.

The control disk 7 is held during this first pivot movement in a friction-locked manner on the toothed pulley 41.

If the first lever 2 is moved further in the adjustment direction V, the control bolt 8 finally comes into contact on the left lateral border of the opening 73 of the control disk 7.

From a predetermined adjustment angle γ, according to an embodiment variant shown in FIG. 12, a first support surface 75 of the switchover contour 74 of the control disk 7 is pushed onto a first support surface 55 of the pawl 5 on the left of the recess 54 and thus again disengages the teeth 52 of the pawl 5 from the outer toothing 42 of the toothing 4, so that upon a further pivot of the first lever 2 in the adjustment direction V, the pawl 5 is now held disengaged from the toothing 4 due to the now common movement with the control disk 7. The control disk 7 is moved along in this case with the control bolt 8 secured fixed in place on the first lever 2.

To assume a catch position, the second lever 2 is moved slightly, preferably by an angle of approximately 2°, in the reset direction R because of the preferred formation of the teeth of the toothing 4 and the teeth 52 of the pawl 5.

In this case, the switchover contour 74 slides the control disk 7 back into the recess 54 of the pawl 5 again, so that the teeth 52 of the pawl 5 latch with the outer toothing 42 of the toothed pulley 41. Such an angular position of the pivot fitting 1 is illustrated by way of example in FIG. 1.

In the alternative embodiment variant shown in FIGS. 8 and 13, the geometry of the switchover contour 74' of the control disk 7 is different from the switchover contour 74 (shown in FIG. 7), in such a way that the switchover contour 74' has a lesser angular width, so that the pawl 5 is moved from one catch position to the next upon further movement of the first lever 2 out of the position shown in FIG. 11 in the adjustment direction V.

This variant of the switchover contour shown in FIG. 8 enables audible catching of the pawl 5 during the adjustment in the adjustment direction V.

The geometry of the teeth 52 of the pawl 5 and the outer toothing 42 of the toothing 4 is selected in this case so that a displacement in the adjustment direction is enabled and a displacement in the reset direction is obstructed.

A switchover position is illustrated in FIG. 15, in which the first lever 2 is pivoted by the maximum adjustment angle α in relation to the second lever 3. In this position, the teeth 52 of the pawl 5 are lifted out of the engagement with the outer toothing 42 of the toothing 4 with the aid of the second control disk 9. The functionality of the second control disk is described hereafter on the basis of FIGS. 20 to 25.

During a subsequent pivot of the first lever 2 in relation to the second lever 3 in the reset direction R, the control disk 7, again because of the friction-locked holding, remains fixed in place in its position until the control bolt 8 reaches the left border of the opening 73 of the control disk 7 in FIG. 16.

During this pivot movement up into the position shown in FIG. 16, the second support surface of the control disk 7 is again pushed onto the second support surface 56 of the pawl 5, so that the pawl 5 is still held disengaged from the toothing 4 and thus enables the pivoting of the first lever 2 in the reset direction R.

If, during the pivot of the first lever 2 in the reset direction R, the pivot fitting 1 is now latched again in such an intermediate position before reaching the base position, for example, in the position shown in FIG. 17, it is thus only necessary to move the first lever 2 slightly in the adjustment direction V.

Since the control bolt 8 moves inside the opening 73 of the control disk 7 during this pivot movement, the control disk 7 remains fixed in place at its location because of friction during this pivot movement.

The pawl 5 itself is pushed down by the pivot movement from the second support surface of the switchover contour 74 of the control disk 7, so that the teeth 52 of the pawl 5 latch with the outer toothing 42 of the toothing 4. This position is shown in FIG. 19.

The functionality of the second control disk 9 is described hereafter on the basis of FIGS. 20 to 25.

The functionality of the second control disk 9 is now described on the basis of FIGS. 20 to 25.

Figure 20:
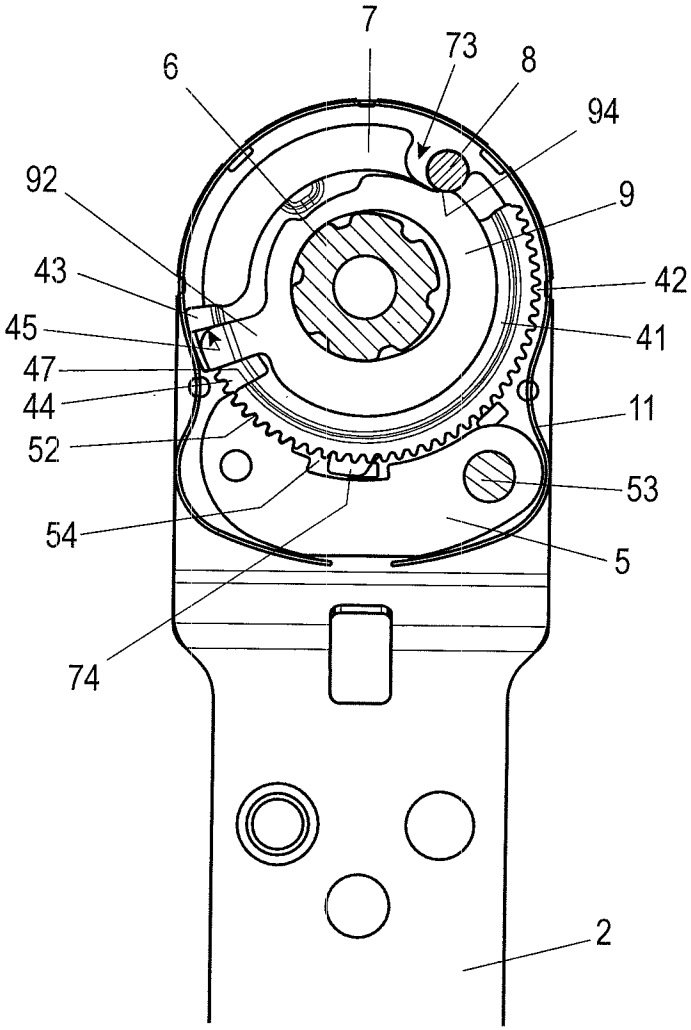

In the illustration shown in FIG. 20, the pivot fitting is already pivoted out of a starting position shown in FIG. 10 into a position in the adjustment direction in which the pawl 5 engages with an outer tooth in a tooth of the outer toothing 42 at the transition region to the recess 44.

In this position, the second control disk 9 reaches a position in which the ramp 94 engages with the control bolt 8.

Figure 21:
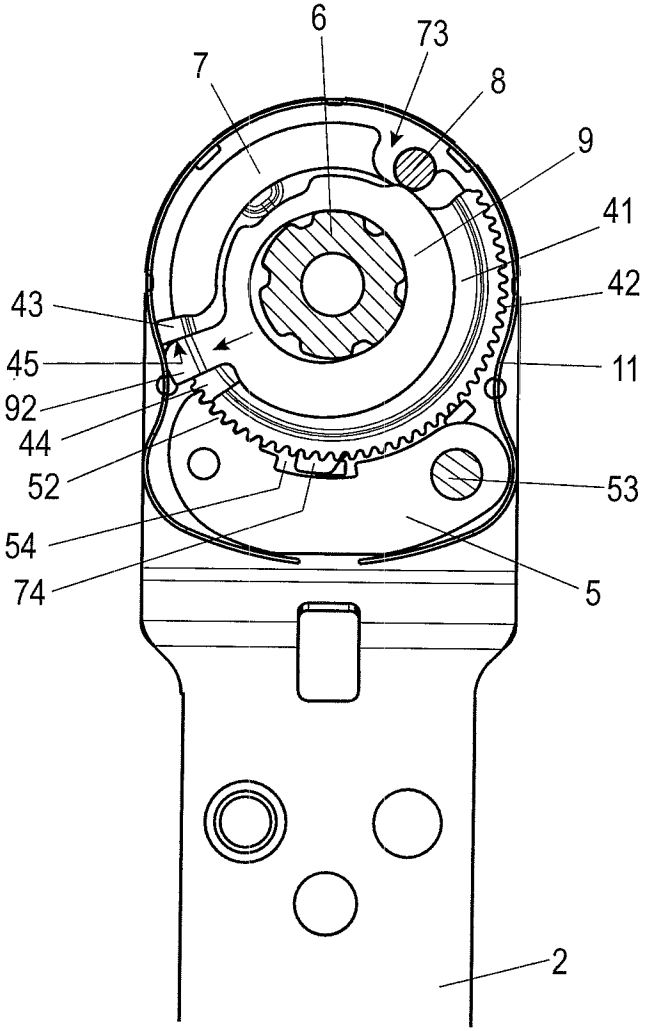

Upon further pivoting of the pivot fitting, the toothing 4 and/or the second lever 3 (not shown here), the control bolt 8 presses the second control disk into the position shown in FIG. 21, in which the radial outer front edge of the switching arm 92 protrudes radially outward beyond the outer toothing 42 and presses the spring element 11 away radially outward at the same time and thus reduces the contact pressure force of the spring element 11 on the pawl 5.

The front edge located on the radial outside of the switching arm 92 is extended in this case at the same height as the protrusion 43, whereby the action diameter of the second control disk 9 enlarges.

Upon further rotation of the toothing 4 in the adjustment direction V, the outer toothing 42 of the pawl 5 initially engages further with a region of the outer toothing 42 of the toothed pulley 41, which is located in the region of the recess 44, until a first lateral border 96 of the switching arm 92 of the second control disk 9 bears on an outer flank 57 of the outermost tooth of the pawl 5 used as an intake bevel.

This first contact surface 96 of the switching arm 92 and the outer flank 57 of the border tooth formed at the free end of the pawl 5 are formed here in such a way that upon relative movement of the levers 2, 3 in the reset direction R, the pawl can be pressed away by the switching arm 92 from the outer toothing 42.

The angle of attack of the outer flank 57 and the first contact surface 96 of the switching arm 92 is, in the embodiment variant shown here, preferably between 8° and 12°, in particular approximately 10° in relation to a radial of the rotational axis D.

Figure 22:
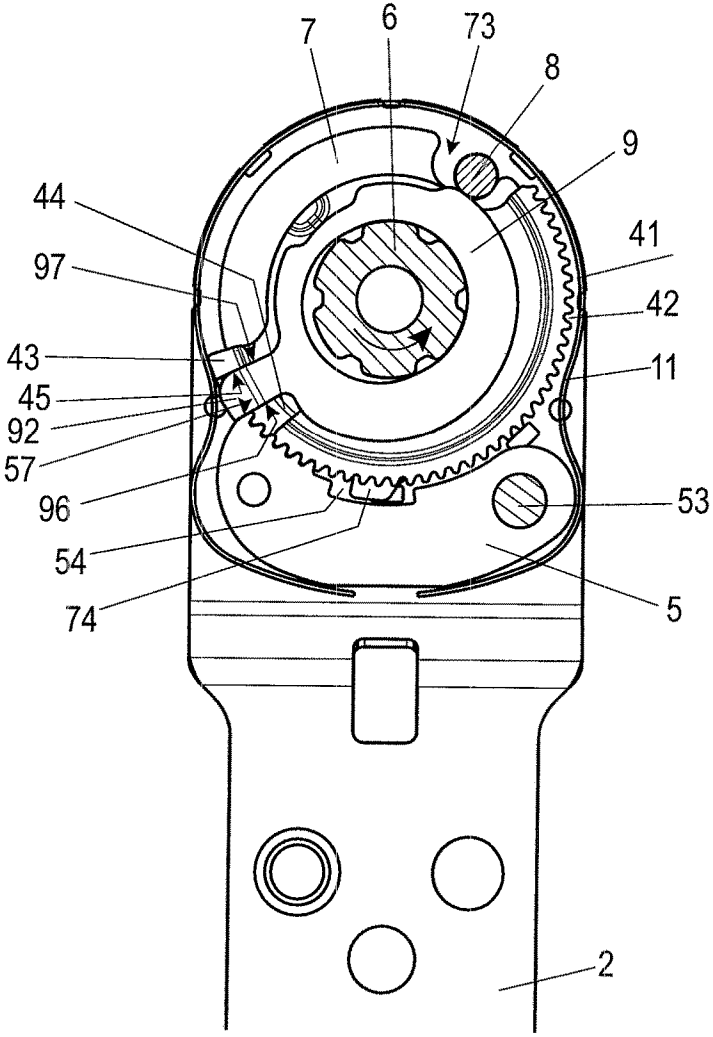

By slight further rotation out of this position shown in FIG. 22 into the position shown in FIG. 23, which is preferably at approximately 7°, the switchover point is reached.

As shown in FIG. 23, the front edge of the switching arm 92 is pushed below the border tooth at the free end of the pawl 5 at the switchover point, so that the toothing 52 of the pawl 5 is disengaged from the outer toothing 42 of the toothed pulley 41 and now enables a movement in the reset direction R.

The second control disk 9 is clamped in this position between the pawl 5 and the control bolt 8 via the force of the spring element 11.

Upon pivoting of the pivot fitting in the reset direction R, for example, by approximately 10°, the pivot position shown in FIG. 24 is reached.

As shown in FIG. 24, the control disk 9 still remains clamped in a stationary manner between the pawl 5 and the control bolt 8, which is enabled by the angular width of the recess 44.

The standstill of the second control disk 9 in this position enables, upon the pivot in the reset direction R, the first control disk 7 to now be pushed with its second support surface onto the second support surface 56 of the pawl 5 and thus the pawl 5 to now still be held disengaged by the first control disk 7 from the outer toothing 42 of the toothed pulley 41.

During the further movement of the pivot fitting 1 in the direction of the base position, the second control disk 9 is pushed down from the teeth of the pawl 5 with the aid of the first fitting 47.

At the same time, during the rotation of the second control disk 9, as shown in FIG. 25, a region of the ring disk 91 of the second control disk 9 having smaller ring width moves in front of the control bolt 8, so that the front edge of the switching arm 92 located on the radial outside is displaced by the contact pressure of the second spring element 11 back into a position radially inside the toothing 42 of the toothing 4.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 pivot fitting
2 first lever
2*a* first cover
2*b* second cover
21 lever arm
22 bending range

23 lever head
24 borehole
25 receptacle
26 borehole
27 recess
28 reinforcement
3 second lever
31 lever arm
32 lever head
33 receptacle
4 toothing
41 toothed pulley
42 outer toothing
43 protrusion
44 recess
47 first stop
5 pawl
51 pawl arm
52 teeth
53 bearing borehole
54 recess
55 first support surface
56 second support surface
57 outer flank
59 fixing bolt/pawl bolt
6 force shaft
7 first control disk
71 ring
72 recess
73 opening
74 switchover contour
74' switchover contour
75 first support surface
76 second support surface
8 control bolt
9 second control disk
91 ring disk
92 switching arm
93 oblong hole
94 ramp
96 lateral border/contact surface
10 first spring element
11 second spring element
12 central bolt
13 bearing ring
14 disk
100 piece of furniture
101 furniture body
102 backrest
103 armrest
D axis
V adjustment direction
R reset direction
$\alpha$ maximum adjustment angle
$\beta$ switching angle
$\gamma$ switching angle

The invention claimed is:

1. A pivot fitting for movable furniture parts on pieces of seating or reclining furniture, the pivot fitting comprising:

a first lever and a second lever, wherein the first and second levers are mounted so they are pivotable in relation to one another around a common axis out of a base position by a predetermined angle;

a clamping mechanism configured to fix the first and second levers in relation to one another in different angle positions within the predetermined angle, wherein the clamping mechanism comprises a toothing secured in a rotationally-fixed manner on the second lever;

a pawl, which is mounted so it is pivotable on the first lever and is loaded in a direction of the toothing, and which is engaged with the toothing in a catch position;

a first control disk mounted so it is rotatable around the common axis, wherein the first control disk is used to disengage the pawl from the toothing after running over the predetermined angle from the base position in an adjustment direction, so that if the pawl is disengaged from the toothing by running over the predetermined angle in a reset direction, the first and second levers are pivotable back into the base position; and a second control disk, which is mounted so it is rotatable around the common axis, is configured to be carried along by the toothing and is mounted so it is rotatable by a switching angle in relation to the toothing.

2. The pivot fitting of claim 1, wherein the toothing is an at least partially-circular toothed pulley having an outer toothing formed on a partially-circular outer border, which is coupled via a force shaft forming the common axis to the second lever, and the pawl comprises a pivot arm having teeth facing toward the common axis.

3. The pivot fitting of claim 1, wherein the first control disk comprises an opening, in which a control bolt fastened on the first lever is accommodated, wherein the opening is dimensioned such that the control bolt is displaceable by the switching angle in relation to the first control disk.

4. The pivot fitting of claim 1, wherein the first control disk is a disk spring or spring plate.

5. The pivot fitting of claim 1, wherein the first control disk is configured to be carried along by bearing in a friction-locked manner on the toothing and is mounted so it is rotatable by a switching angle in relation to the first lever.

6. The pivot fitting of claim 2, wherein the first control disk comprises a switchover contour on an outer circumference, using which the pawl is pivotable out of a catch position with the toothing into a non-catch position.

7. The pivot fitting of claim 6, wherein the pawl, adjacent to the teeth forming an inner toothing, comprises a recess, into which the switchover contour is inserted in the catch position of the pawl with the toothing.

8. The pivot fitting of claim 7, wherein edges of the pawl framing the recess are support surfaces configured to support the pawl on the switchover contour of the first control disk.

9. The pivot fitting of claim 2, wherein the second control disk is a ring disk having an oblong hole accommodating the common axis.

10. The pivot fitting of claim 9, wherein the second control disk comprises a switching arm extending radially outward in a direction of the longitudinal extension of the oblong hole, the switching arm is accommodated in a recess formed on a circumferential border of the toothed pulley, wherein the recess is delimited in the adjustment direction by a first stop in a region of the outer toothing and in the reset direction by a second stop in a region of a protrusion adjoining the outer toothing.

11. The pivot fitting of claim 10, wherein a first contact surface of the switching arm facing toward the first stop and an outer flank of a border tooth formed on a free end of the pawl are configured in such a way that upon relative movement of the first and second levers in the reset direction, the pawl is pressed away from the outer toothing by the switching arm.

12. The pivot fitting of claim 11, wherein an angle of attack of the first contact surface of the switching arm and the outer flank of the border tooth formed at the free end of the pawl in relation to the radial of the rotational axis is between 8° and 12°.

13. The pivot fitting of claim 11, wherein a front edge of the switching arm located on a radial outside protrudes radially outward beyond the outer toothing in a switchover position.

14. The pivot fitting of claim 11, wherein a ramp interacting with a control bolt is formed on a portion of the second control disk remote from the switching arm.

15. The pivot fitting of claim 11, wherein the clamping mechanism comprises a spring element configured to press the pawl against the toothing.

16. The pivot fitting of claim 15, wherein the first lever comprises a first cover and a second cover, wherein the toothing and the first control disk are accommodated between lever heads of the covers, wherein the spring element is arranged between the lever heads, circumferentially enclosing the toothing and the first control disk.

17. A piece of furniture, comprising:

a first furniture part;

a second furniture part; and a pivot fitting coupled to the first and second furniture parts, the pivot fitting comprising a first lever and a second lever, wherein the first and second levers are mounted so they are pivotable in relation to one another around a common axis out of a base position by a predetermined angle;

a clamping mechanism configured to fix the first and second levers in relation to one another in different angle positions within the predetermined angle, wherein the clamping mechanism comprises a toothing secured in a rotationally-fixed manner on the second lever;

a pawl, which is mounted so it is pivotable on the first lever and is loaded in a direction of the toothing, and which is engaged with the toothing in a catch position;

a first control disk mounted so it is rotatable around the common axis, wherein the first control disk is used to disengage the pawl from the toothing after running over the predetermined angle from the base position in an adjustment direction, so that if the pawl is disengaged from the toothing by running over the predetermined angle in a reset direction, the first and second levers are pivotable back into the base position; and a second control disk, which is mounted so it is rotatable around the common axis, is configured to be carried along by the toothing and is mounted so it is rotatable by a switching angle in relation to the toothing.

18. The piece of furniture of claim 17, wherein the first furniture part is furniture body and the second furniture part is an armrest or other adjustable furniture part, and wherein the pivot fitting adjustably fixes the second furniture part.

* * * * *